US006460325B2

(12) United States Patent
Liebig et al.

(10) Patent No.: US 6,460,325 B2
(45) Date of Patent: Oct. 8, 2002

(54) METHOD OF CONVERTING A SYSTEM GENERATING SATURATED STEAM, HAVING AT LEAST ONE STEAM TURBINE GROUP, AND POWER STATION CONVERTED IN ACCORDANCE WITH THE METHOD

(75) Inventors: Erhard Liebig, Laufenburg (DE); Henrik Nielsen, Skodsborg (DK)

(73) Assignee: ALSTOM (Switzerland) Ltd, Baden (CH)

( * ) Notice: Subject to any disclaimer, the term of this patent is extended or adjusted under 35 U.S.C. 154(b) by 28 days.

(21) Appl. No.: 09/739,631

(22) Filed: Dec. 20, 2000

(65) Prior Publication Data

US 2001/0032455 A1 Oct. 25, 2001

(30) Foreign Application Priority Data

Dec. 23, 1999 (DE) ..... 199 62 403

(51) Int. Cl.[7] ..... F02C 6/18
(52) U.S. Cl. ..... 60/39.182; 29/888

(58) Field of Search ..... 60/39.182, 676, 60/772; 29/888, 890.031

(56) References Cited

U.S. PATENT DOCUMENTS

| | | | | | |
|---|---|---|---|---|---|
| 5,660,037 | A | * | 8/1997 | Termuehlen | 60/39.182 |
| 6,021,569 | A | * | 2/2000 | Bannister et al. | 29/888 |
| 6,237,337 | B1 | * | 5/2001 | Bronicki et al. | 60/39.182 |
| 2001/0004829 | A1 | * | 6/2001 | Leibig | 60/39.281 |

* cited by examiner

*Primary Examiner*—Louis J. Casaregola
(74) *Attorney, Agent, or Firm*—Burns, Doane, Swecker & Mathis, L.L.P.

(57) ABSTRACT

A system (1) generating saturated steam is replaced by at least one gas turbine set (29, 30, 31, 36), at least one waste-heat boiler (32) and at least one back-pressure steam turbine (37). The back-pressure steam turbine (37) is coupled to the gas turbine set (29, 30, 31, 36), which back-pressure steam turbine is supplied by the steam generated in the waste-heat boiler (32). The exhaust steam of the back-pressure steam turbine (37) is supplied to the saturated-steam medium-pressure steam turbine (4).

8 Claims, 21 Drawing Sheets

Figure 1:
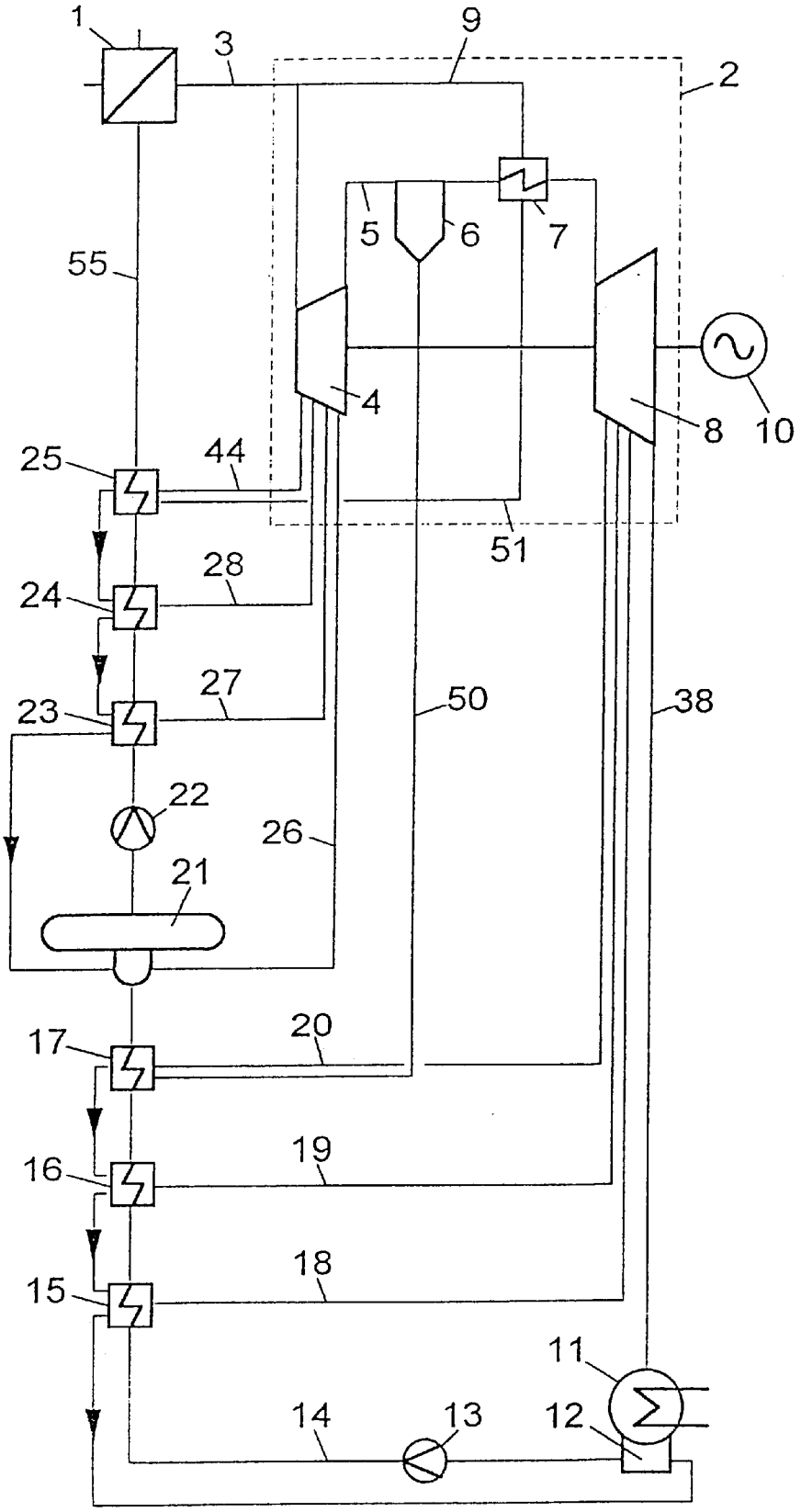

METHOD OF CONVERTING A SYSTEM GENERATING SATURATED STEAM, HAVING AT LEAST ONE STEAM TURBINE GROUP, AND POWER STATION CONVERTED IN ACCORDANCE WITH THE METHOD

Method of converting a system generating saturated steam, having at least one steam turbine group, and power station converted in accordance with the method

BACKGROUND OF THE INVENTION

1. Field of the Invention

The present invention relates to a method of converting a system generating saturated steam, having at least one steam turbine group, into a power station designed for elevated live steam parameters. It also relates to a power station converted in accordance with this method.

2. Related Art

Various permits from the authorities, which have to be awarded at time intervals, are necessary for the building, commissioning and operation of a nuclear power station. For a wide variety of reasons, in particular a change to the political situation, it can occur that no operational permit is awarded for a completely finished nuclear power station or that a permit already awarded is withdrawn. It is also known for governments to operate a withdrawal from nuclear power station technology. The result of this can be investment catastrophes involving an intact water/steam circuit, electrical installations, buildings, cooling water installations, etc.

One possibility for the further utilization of the conventional installation constituent consists in converting the nuclear power station into a combined power station.

In the course of such a conversion from systems generating saturated steam, having steam turbine groups, an effort is made to carry out a conversion into a power station with more elevated steam parameters and involving steam turbine groups designed for more elevated steam parameters in order, by this means, to increase the efficiency of the complete power station, which comprises the system generating saturated steam and the steam turbine groups.

SUMMARY OF THE INVENTION

The invention is therefore based on the object of creating a method of converting a system generating saturated steam, having at least one steam turbine group which has a saturated-steam medium-pressure steam turbine, according to which method a maximum possible part of the original installation technology can continue to be used.

This conversion should, advantageously, be associated with an increase in the power but, at the same time, also with an increase in the efficiency of the overall power station.

The invention finds particular application in the conversion of nuclear power stations whose nuclear installation part has to be put out of action and, subsequently, possibly dismantled.

In accordance with the invention, this is achieved in a first embodiment of the method by the system generating saturated steam being replaced by at least one gas turbine set, at least one waste-heat boiler and at least one back-pressure steam turbine, by the exhaust gas of the at least one gas turbine of the at least one gas turbine set being used for generating steam in the at least one waste-heat boiler, by the steam generated in the at least one waste-heat boiler being supplied via a live-steam line to the at least one back-pressure steam turbine and by the exhaust steam of the at least one back-pressure steam turbine being made available for the supply to the at least one steam turbine group, preferably to a saturated-steam medium-pressure steam turbine of the steam turbine group. The exhaust steam conditions of the at least one back-pressure steam turbine correspond essentially, in accordance with a preferred embodiment, to the previous steam parameters at the inlet to the existing steam turbine group. In this first embodiment, the complete steam turbine group is retained in its previous form.

In a second embodiment of the method, the design of the at least one waste-heat boiler and of the at least one back-pressure steam turbine is modified in such a way that the steam parameters between back-pressure steam turbine and saturated-steam medium-pressure steam turbine are displaced to more elevated temperatures and lower pressures within the ranges permissible for the saturated-steam medium-pressure steam turbine and in such a way that the final expansion point at the outlet from the saturated-steam medium-pressure steam turbine is moved to lower steam wetnesses and, if possible, into the superheated range, in such a way as to dispense with the separator and also, if possible, the reheater between saturated-steam medium-pressure and low-pressure steam turbines.

In a third embodiment of the method, the replacement occurs in each case by means of a waste-heat boiler with reheater, the saturated-steam medium-pressure steam turbine of each steam turbine group being replaced by at least one new medium-pressure steam turbine designed for more elevated steam parameters, the exhaust steam from the at least one back-pressure steam turbine being made available for supplying the reheater of the at least one waste-heat boiler, this steam being reheated and the reheated steam being made available for supplying the at least one new medium-pressure steam turbine. The new medium-pressure steam turbine is advantageously designed in such a way that the parameters of its exhaust steam are at least approximately equal to the steam parameters at the inlet to the low-pressure steam turbine of the original steam turbine group, so as to dispense with the separator, and if possible also the reheater between the new medium-pressure steam turbine and the low-pressure steam turbine.

A power station converted according to a first version of an installation for carrying out the method and containing at least one steam turbine group having a saturated-steam medium-pressure steam turbine, a separator, a reheater operating with saturated steam, and a low-pressure steam turbine, is characterized by at least one gas turbine set, at least one waste-heat boiler and at least one back-pressure steam turbine as replacement for the original system generating saturated steam, and by the at least partially retained at least one steam turbine group of the original power station.

According to a second version of the installation for carrying out the method, the at least one waste-heat boiler and the at least one back-pressure steam turbine are designed in such a way that the steam parameters between back-pressure steam turbine and saturated-steam medium-pressure steam turbine are located within the ranges of high temperature and low pressure which are permissible for the saturated-steam medium-pressure steam turbine, and in such a way that the final expansion point at the outlet from the saturated-steam medium-pressure steam turbine is located within the ranges of steam wetness which is lower than that of the original power station. It is then possible to dispense with the separator of the original power station. A further embodiment provides for parameter ranges specified in such a way that the final expansion point at the outlet of the saturated-steam medium-pressure steam turbine is located within a range of superheated steam so that, in addition, it is also possible to dispense with the superheater.

A third configuration of the installation for carrying out the method is characterized by at least one gas turbine set, at least one waste-heat boiler with reheater, at least one back-pressure steam turbine and at least one medium-pressure steam turbine as replacement for the original system generating saturated steam and the saturated-steam medium-pressure steam turbine, the steam parameters at the outlet from the reheater being specified in such a way that, in the converted power station, the at least one steam turbine group is retained with a new medium-pressure steam turbine adapted to the parameters at the outlet from the reheater, and without separator and without reheater.

The advantages of the invention may essentially be seen in the fact that a nuclear power station, in particular, can be converted to a combined power station with minimum investment while continuing to retain, as far as possible, the conventional installation technology, and a power station can be obtained whose power and whose efficiency are higher than those of the original nuclear power station.

BRIEF DESCRIPTION OF THE DRAWING FIGURES

Embodiment examples of the invention are shown in the figures of the drawing. Only the elements essential to the understanding of the invention are shown.

Figure 2:
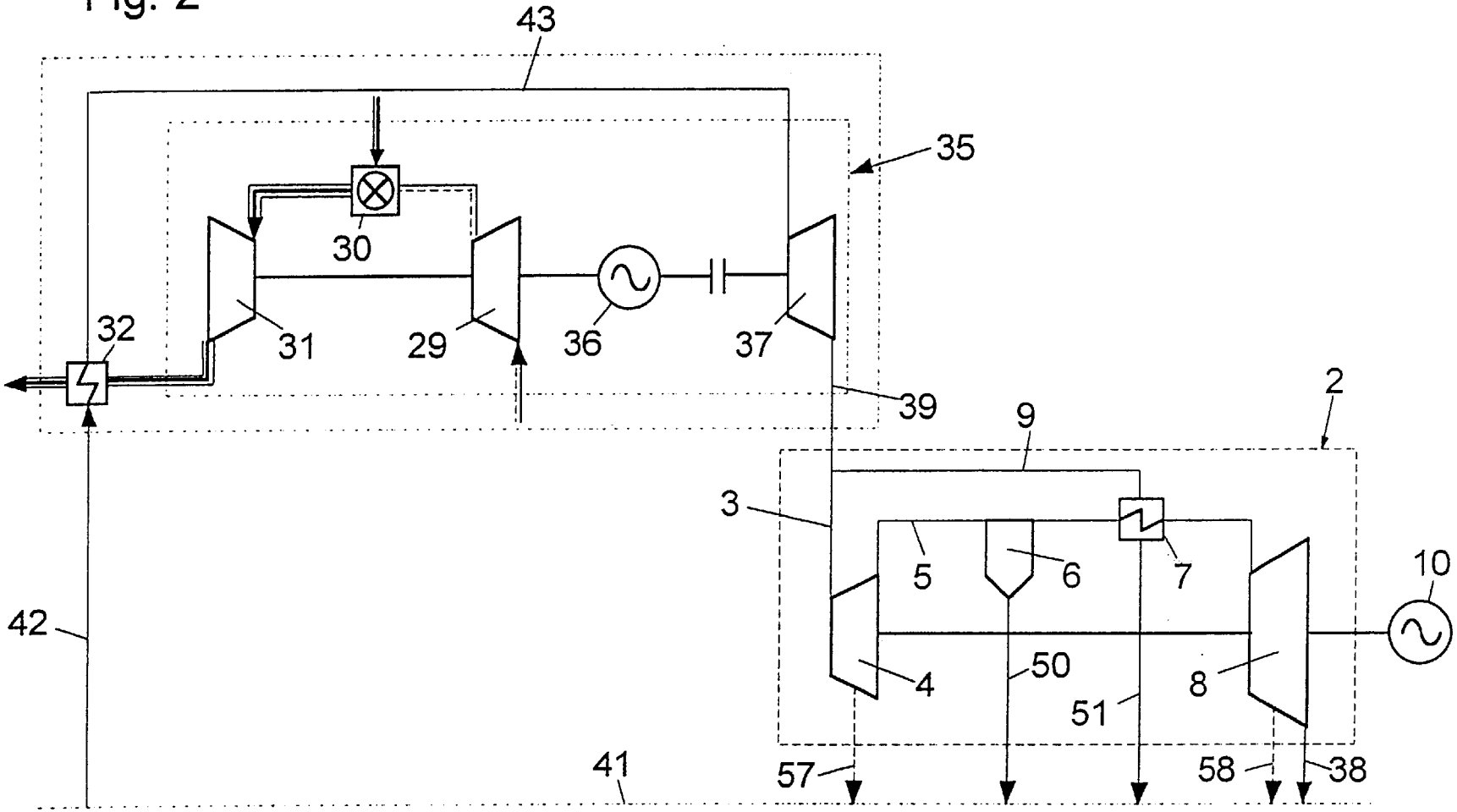
Figure 3:
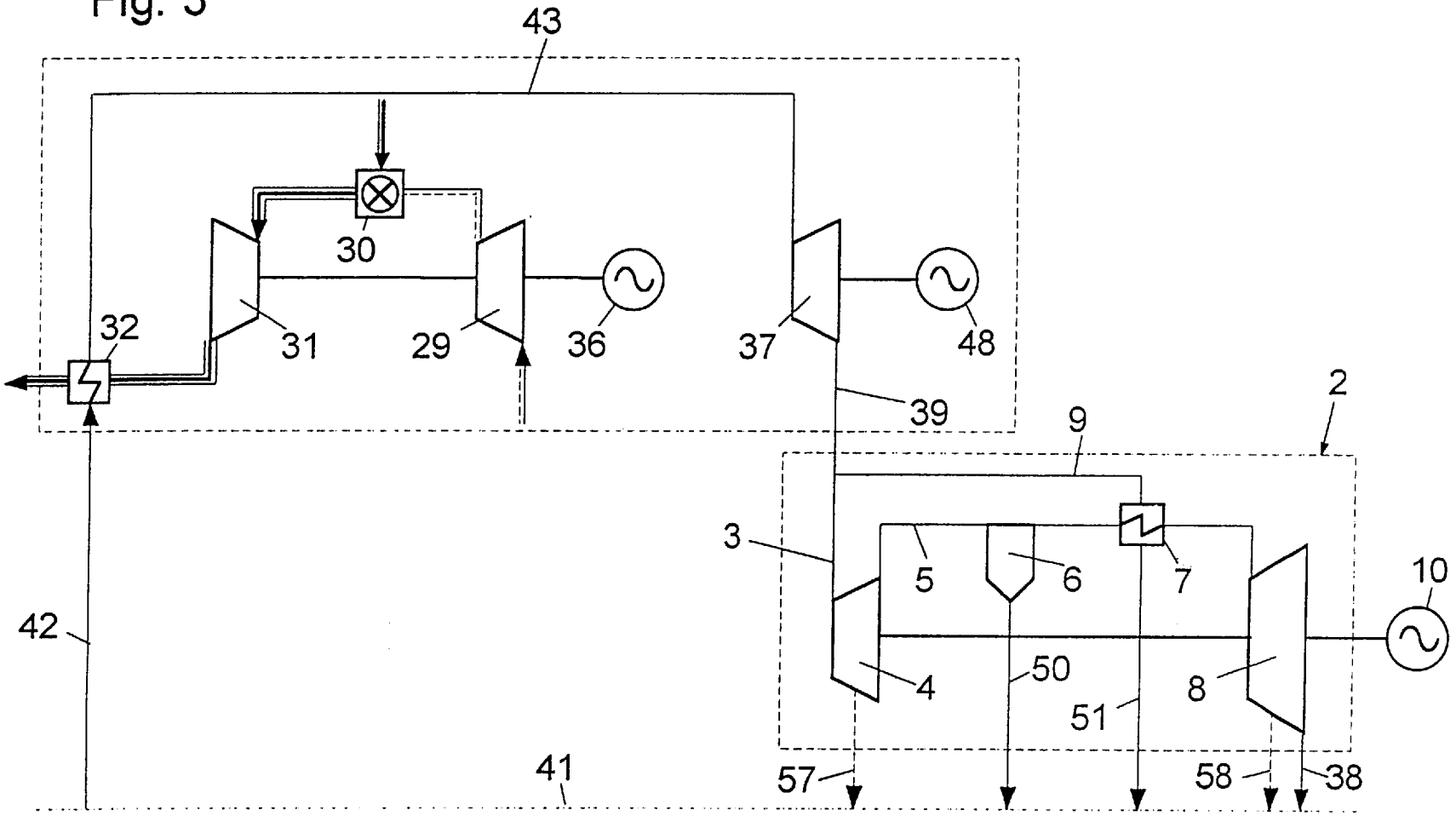
Figure 4:
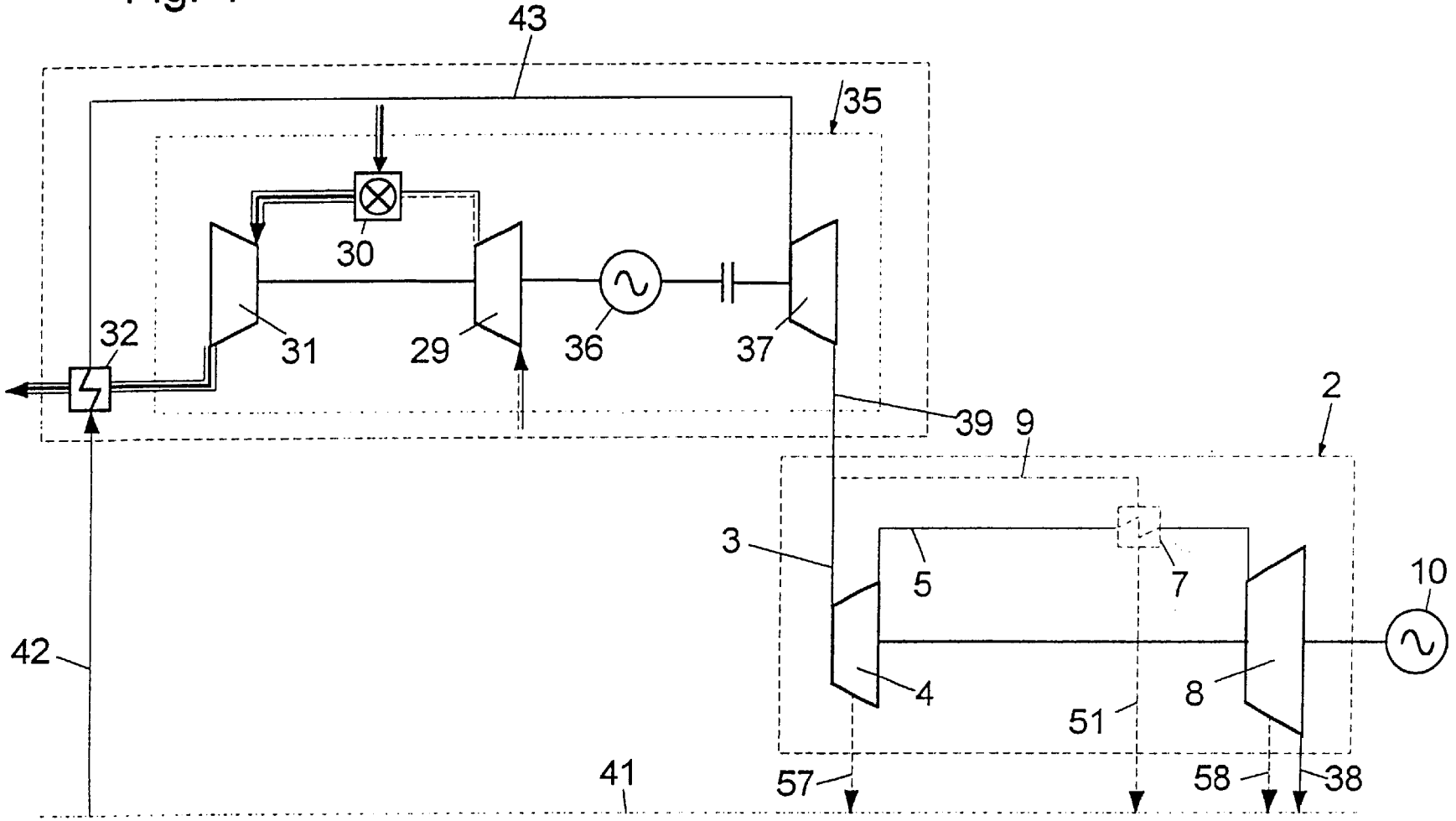
Figure 5:
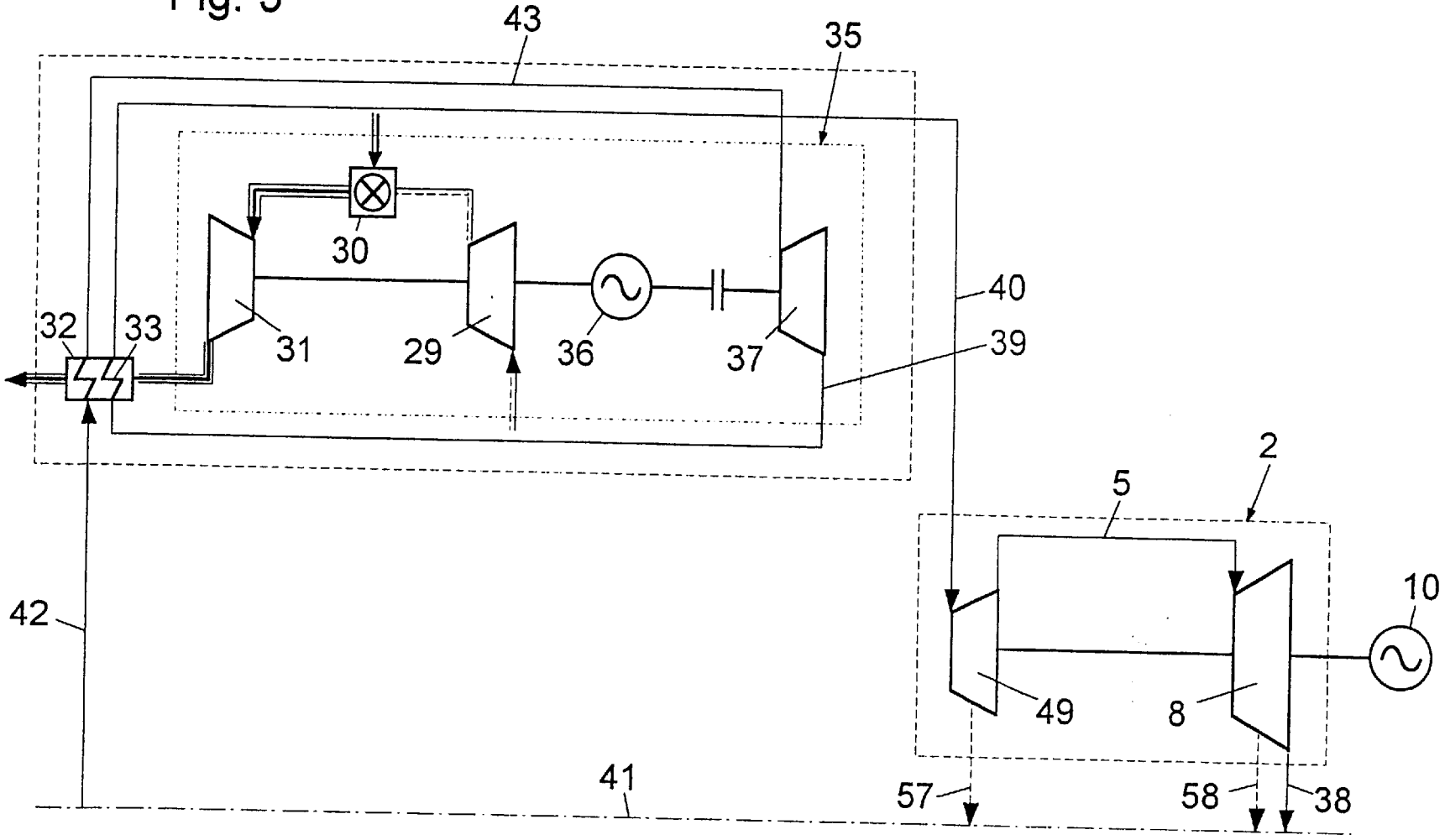
Figure 6:
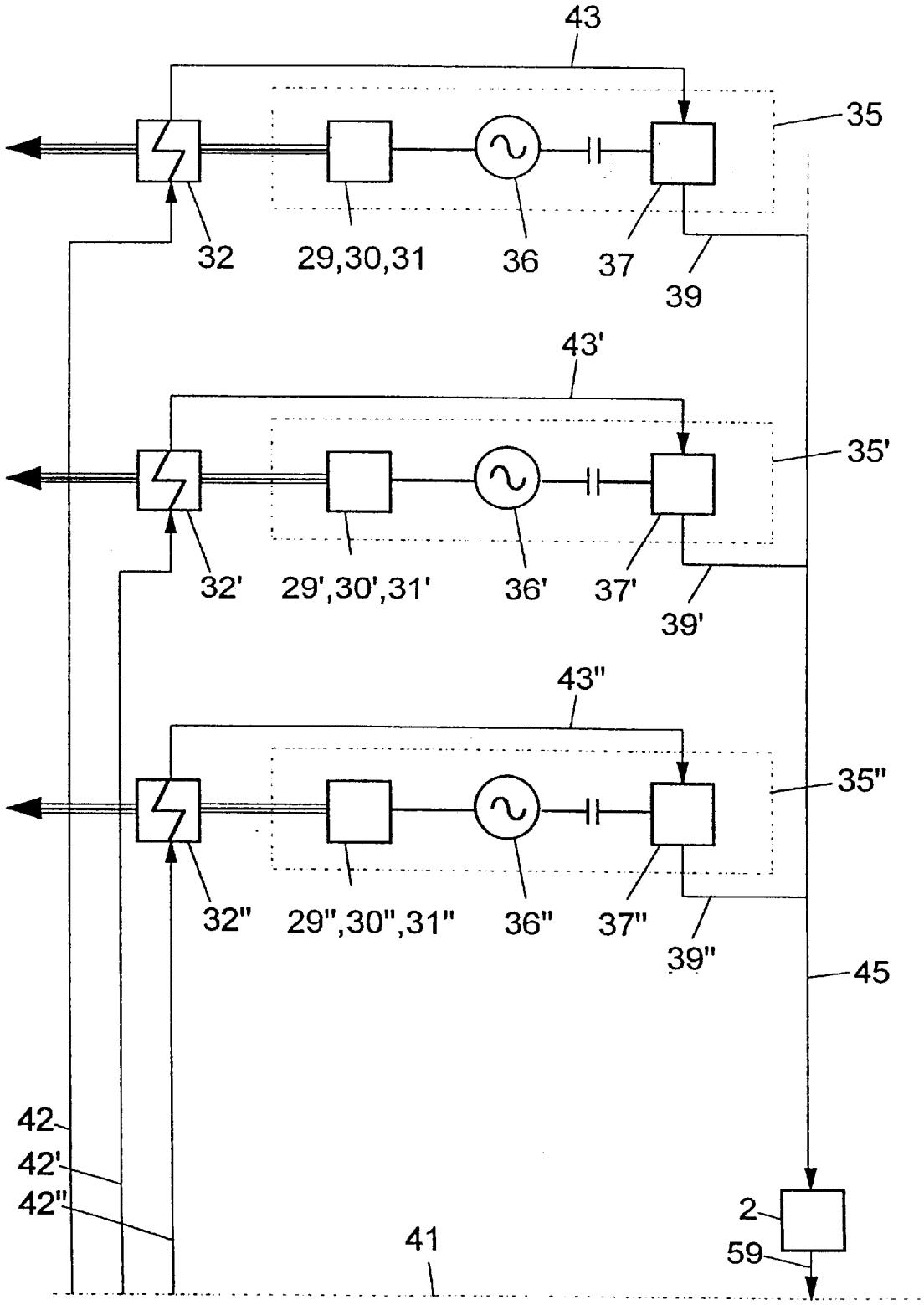
Figure 7:
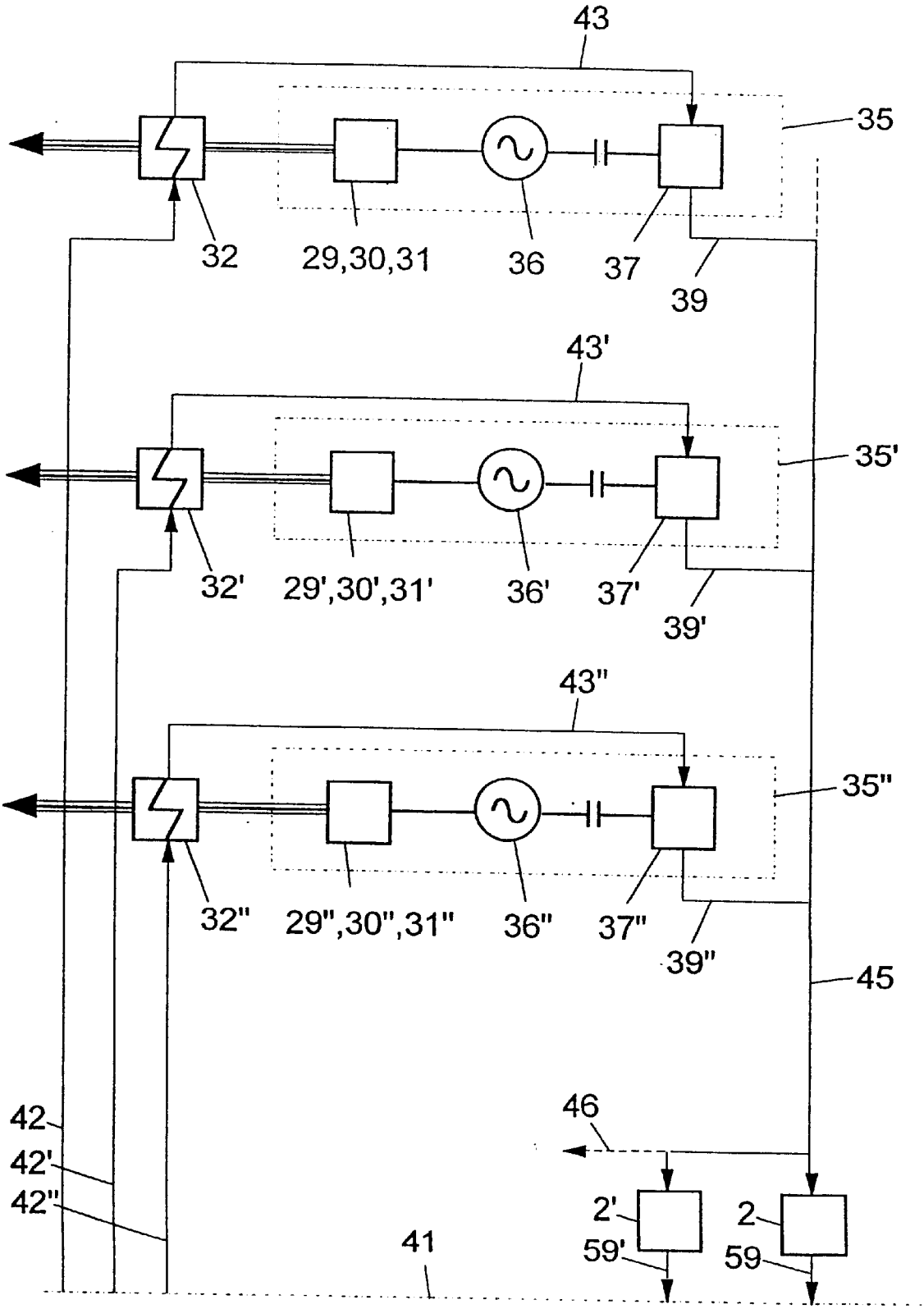
Figure 8:
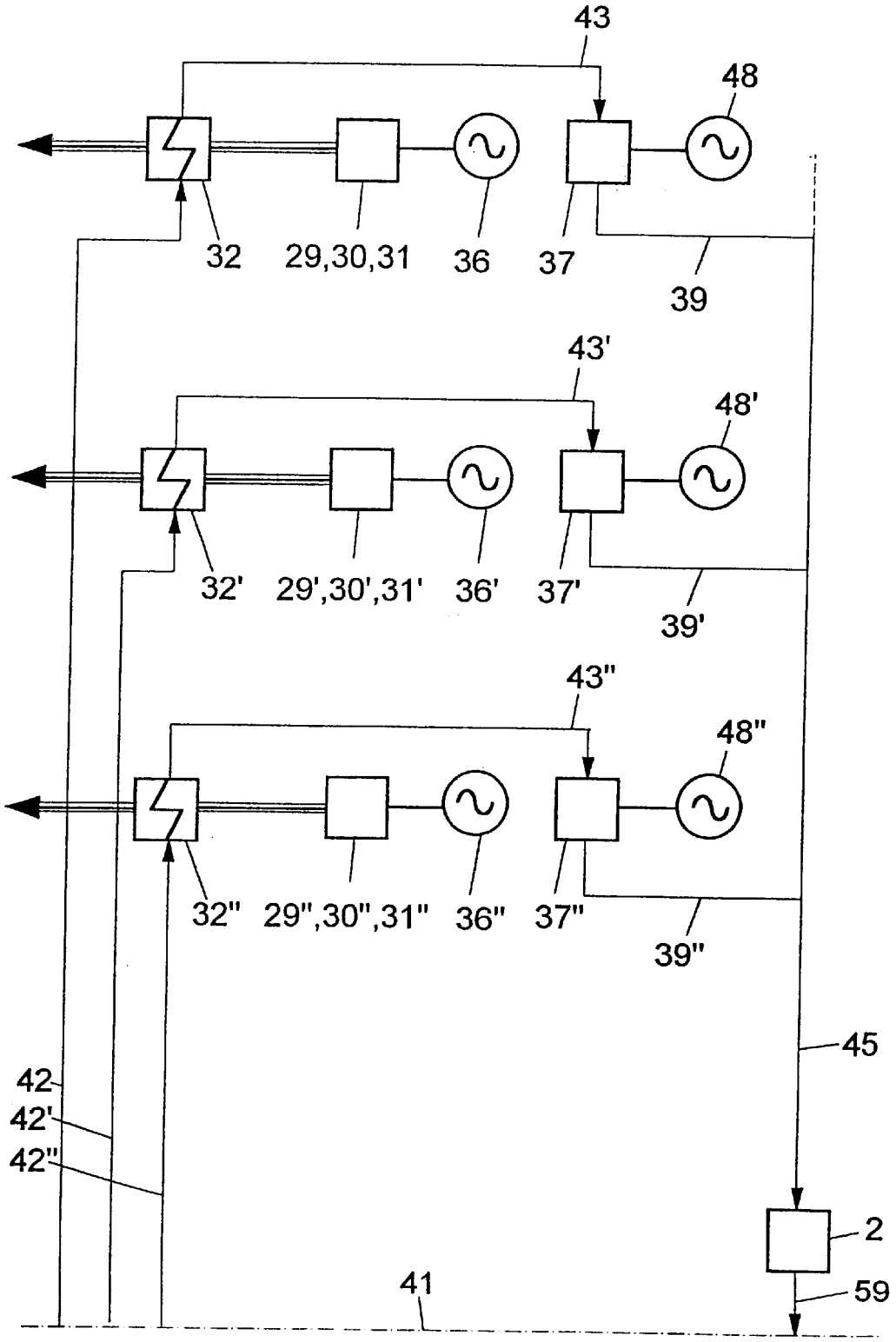
Figure 9:
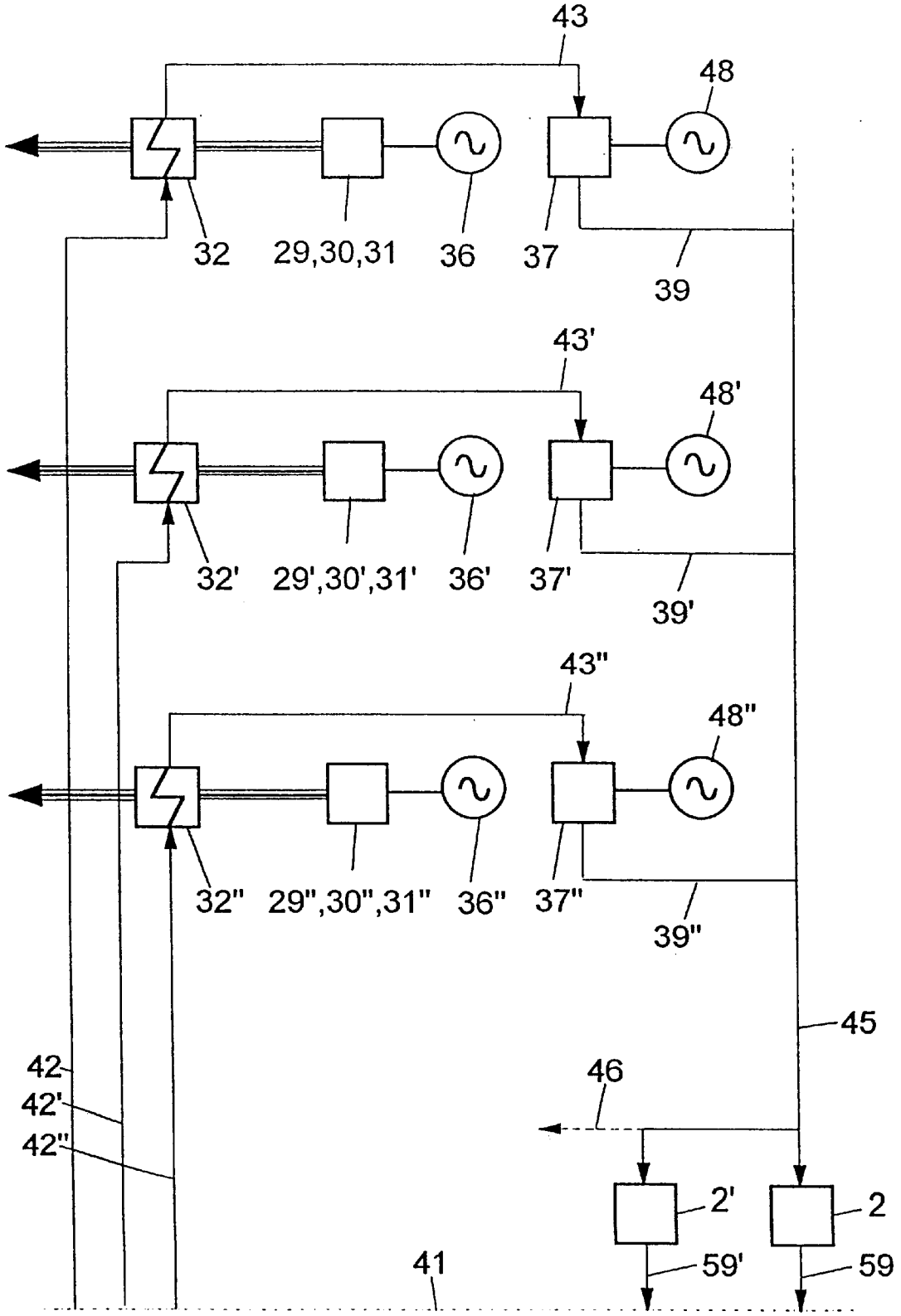
Figure 10:
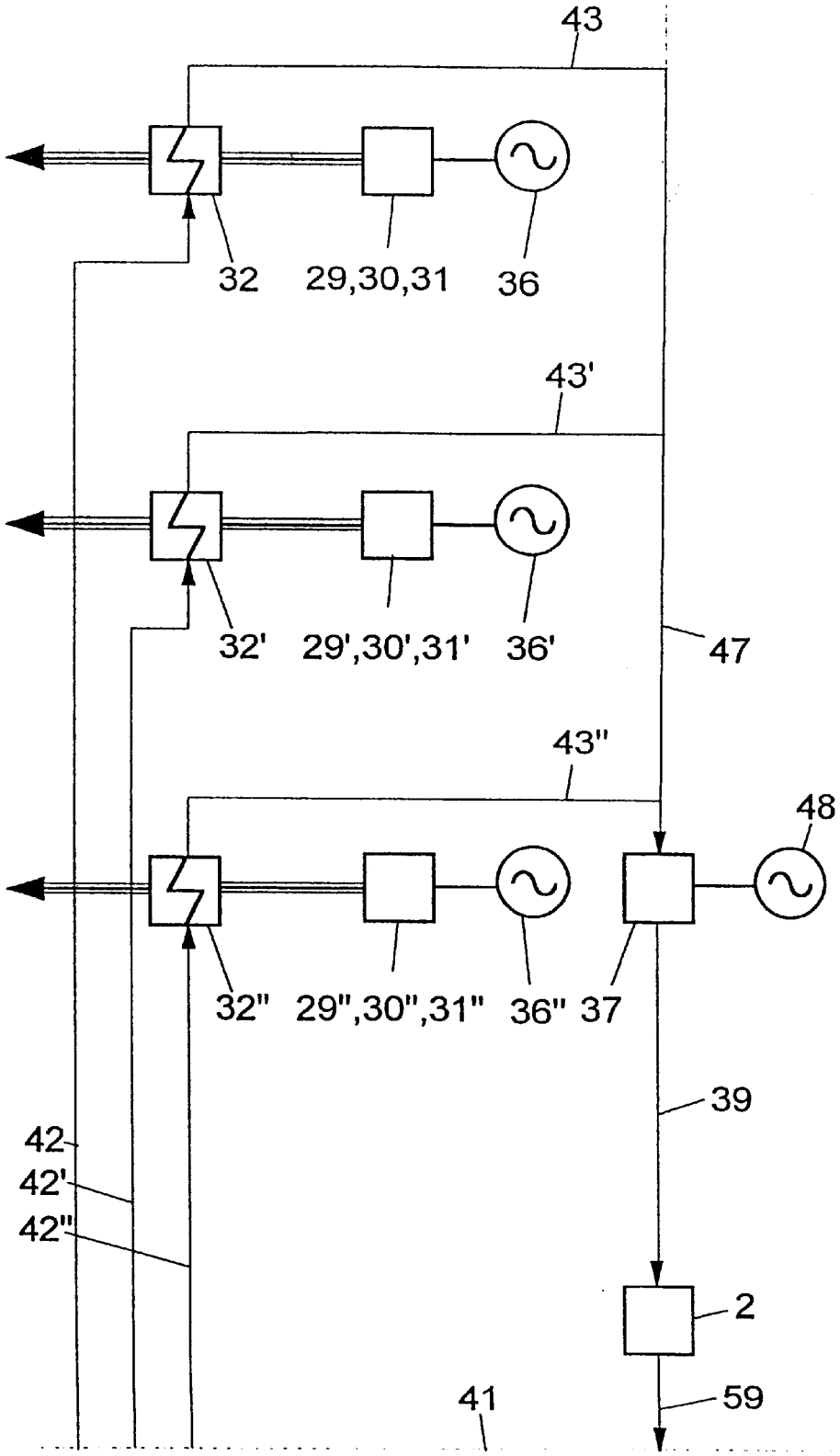
Figure 11:
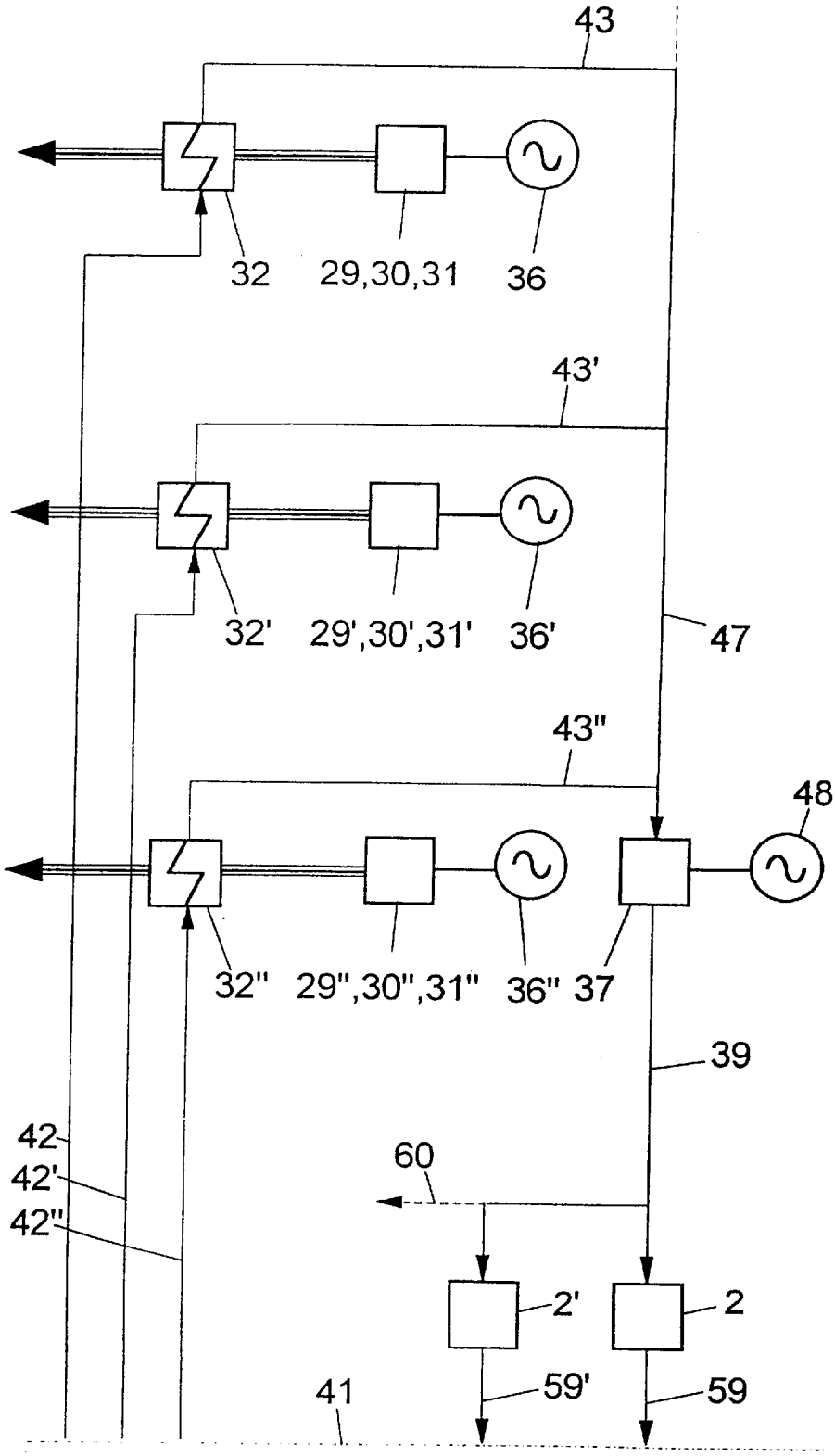
Figure 12:
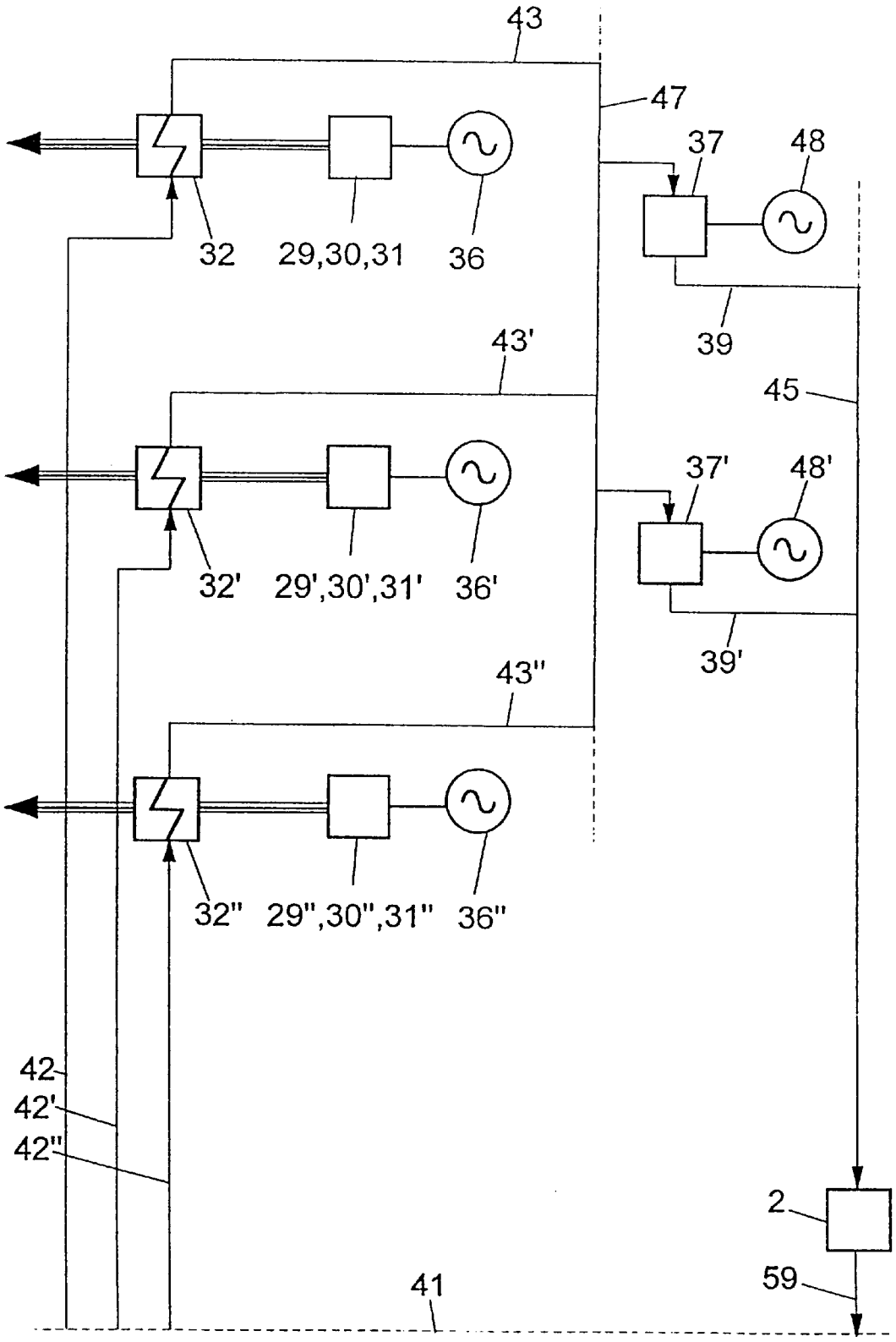
Figure 13:
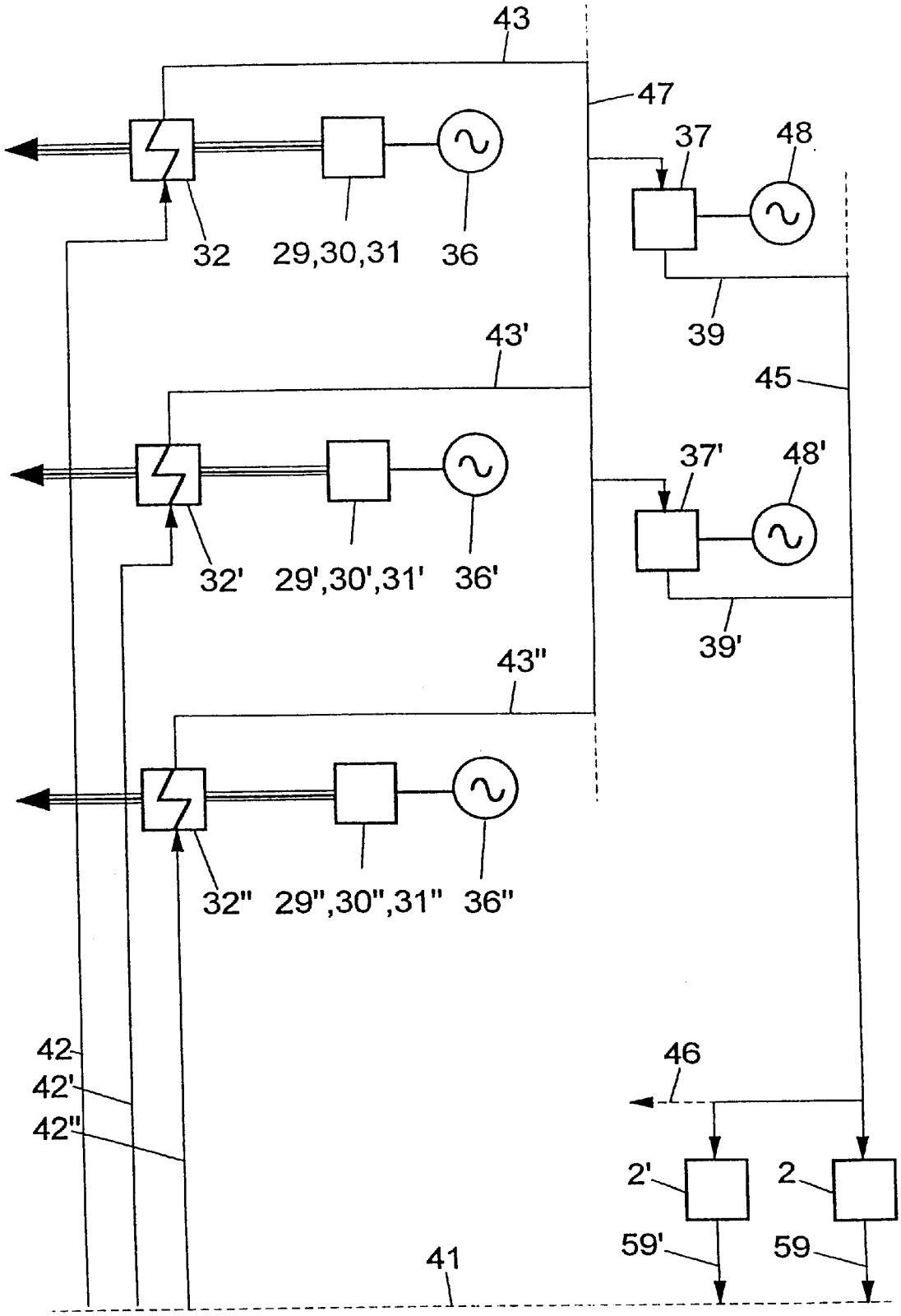
Figure 14:
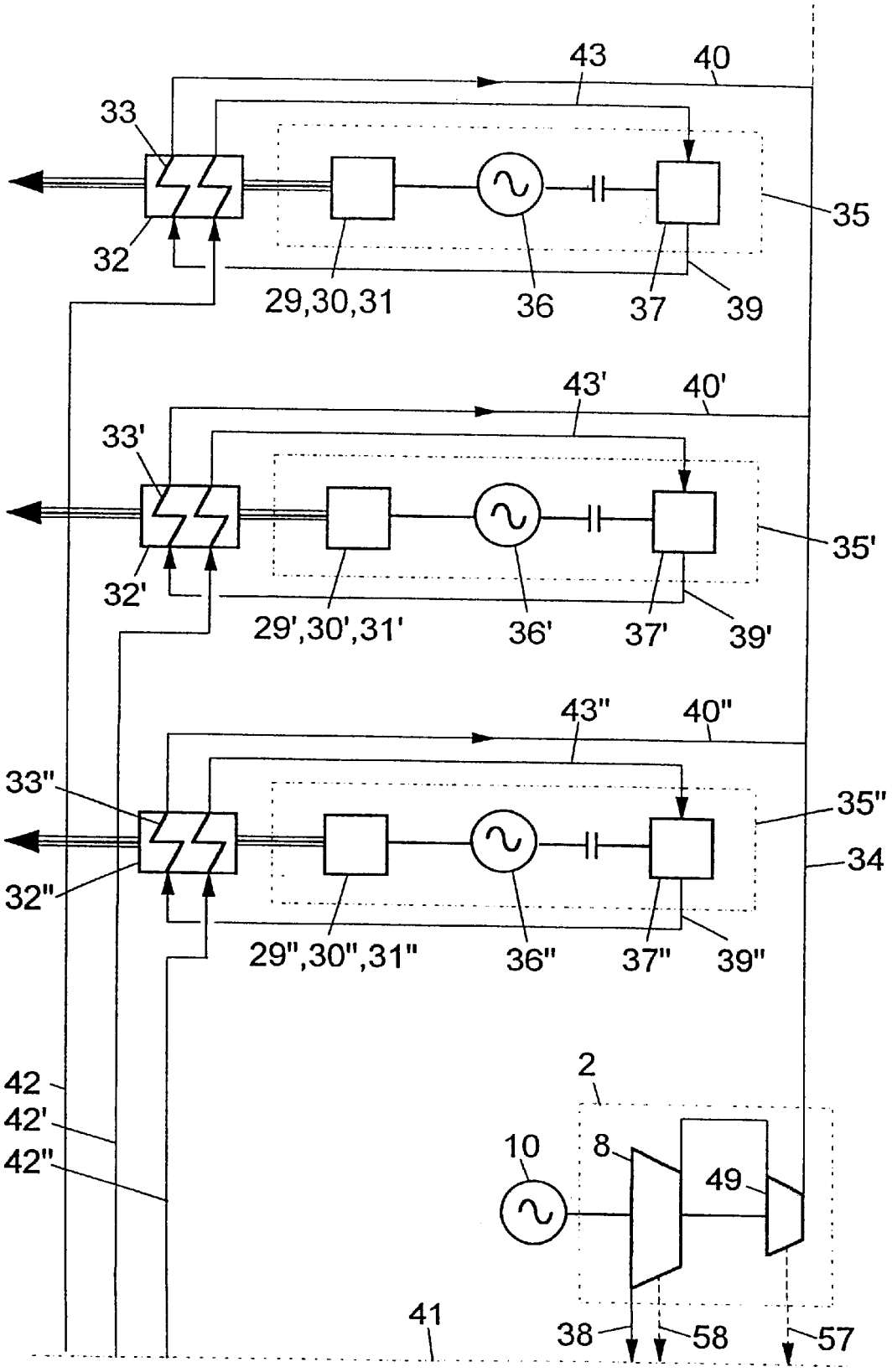
Figure 15:
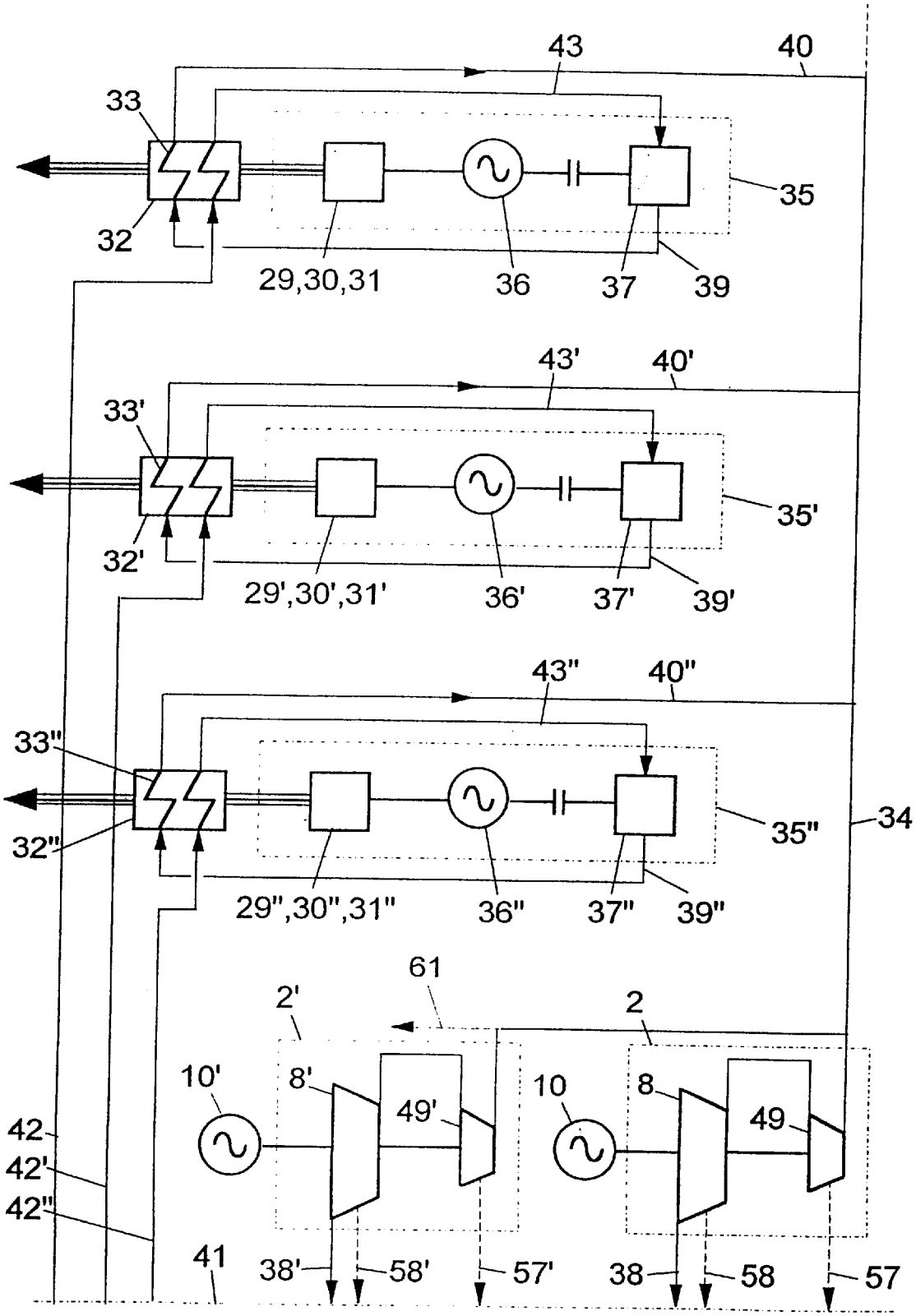
Figure 16:
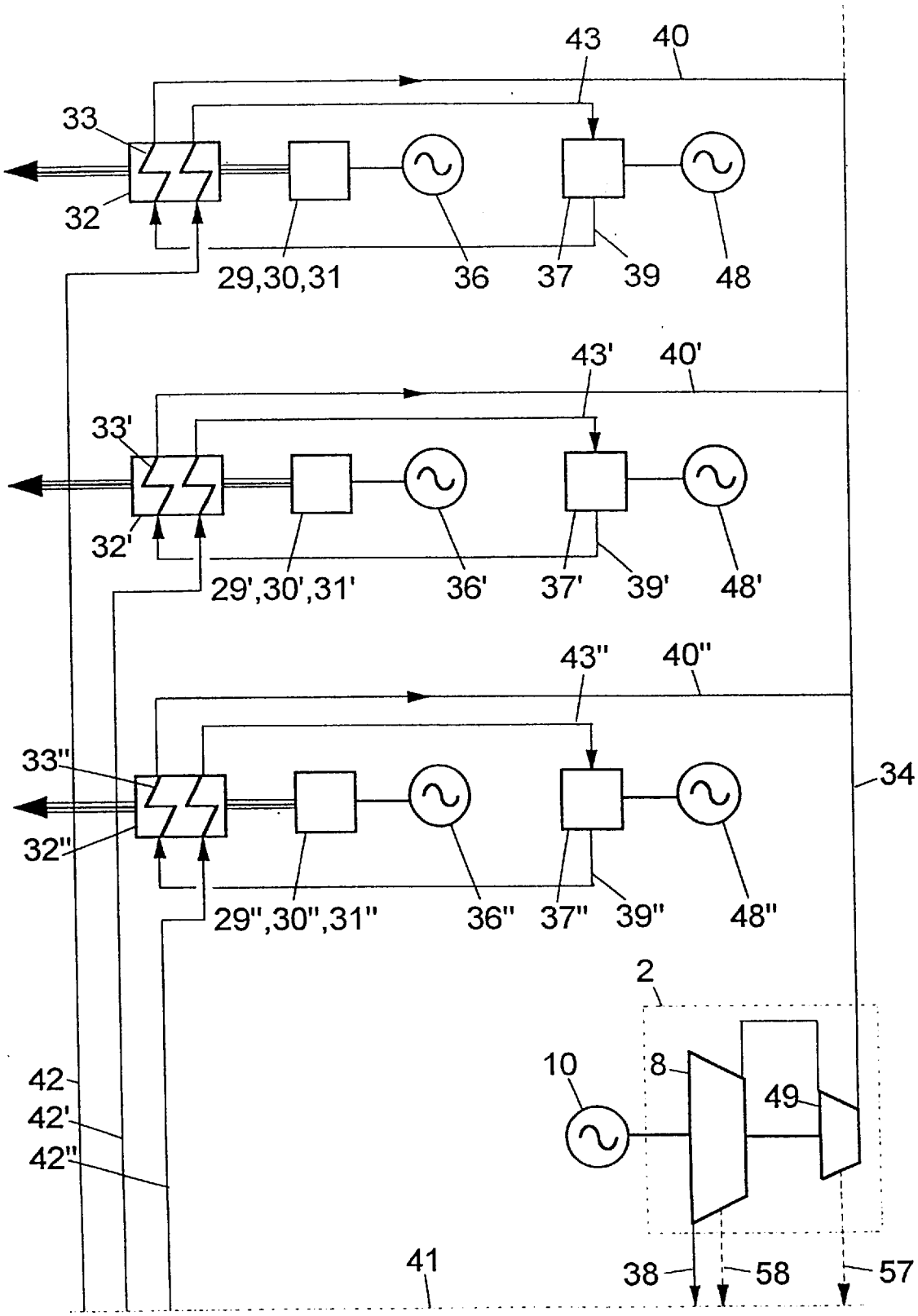
Figure 17:
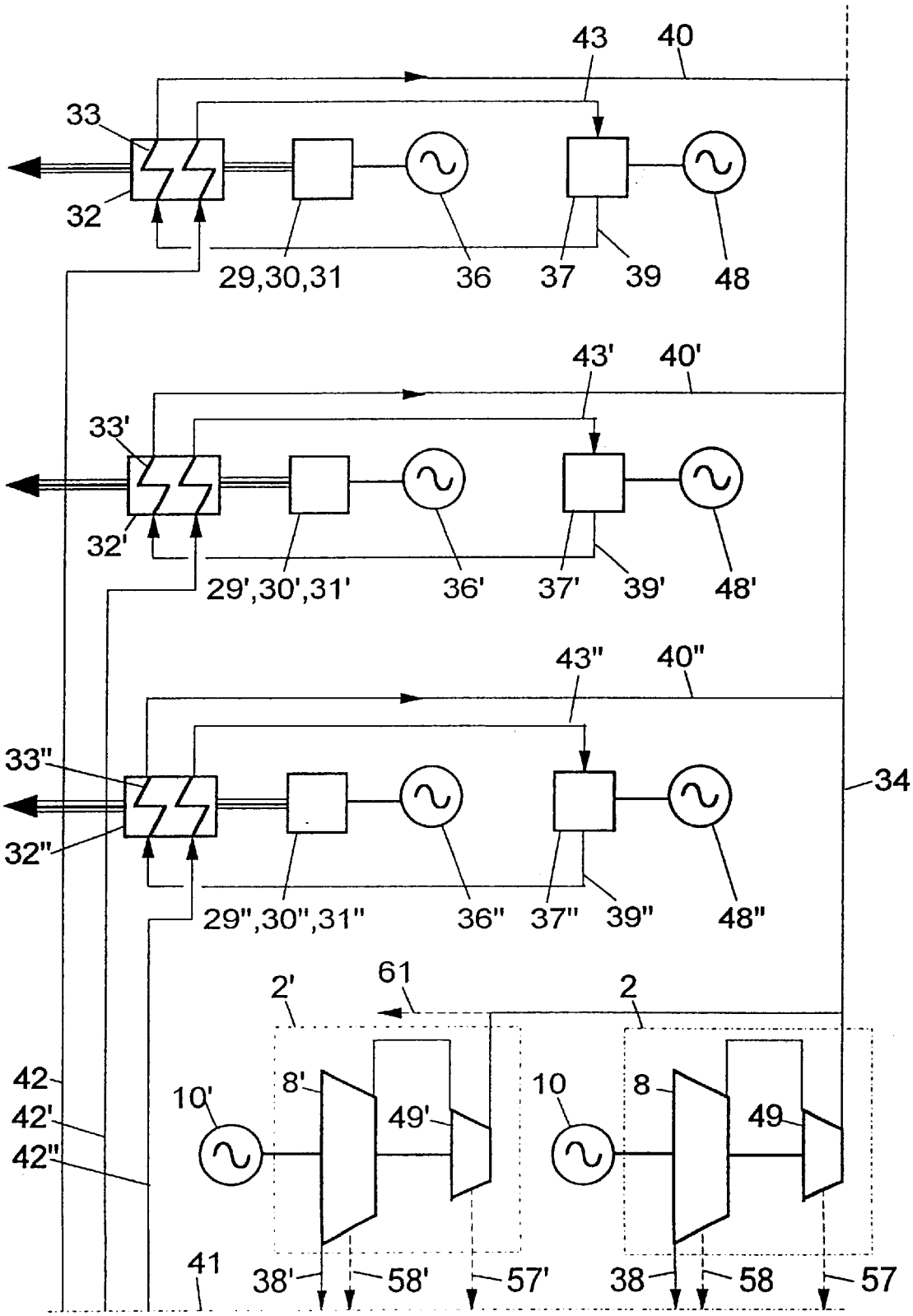
Figure 18:
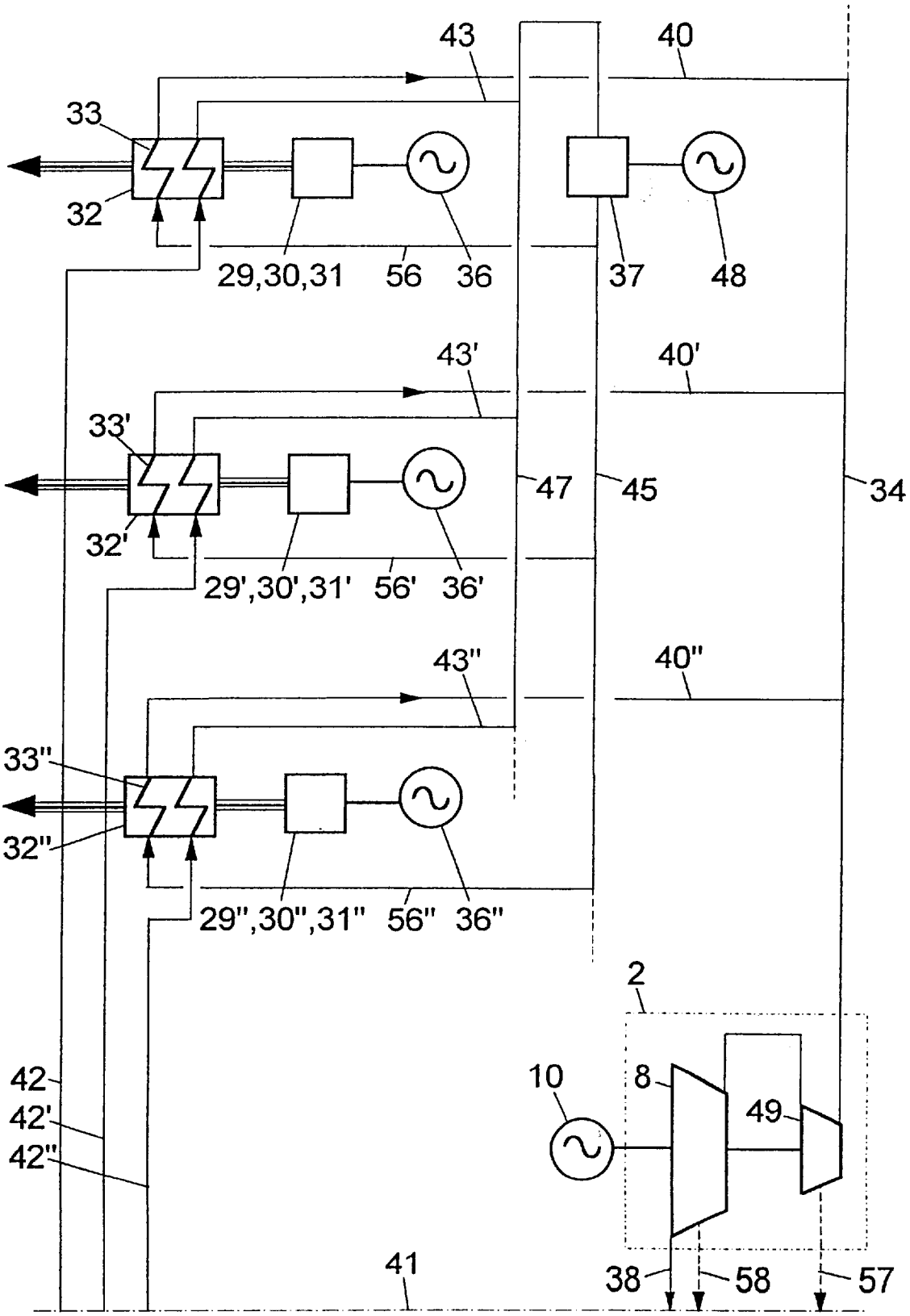
Figure 19:
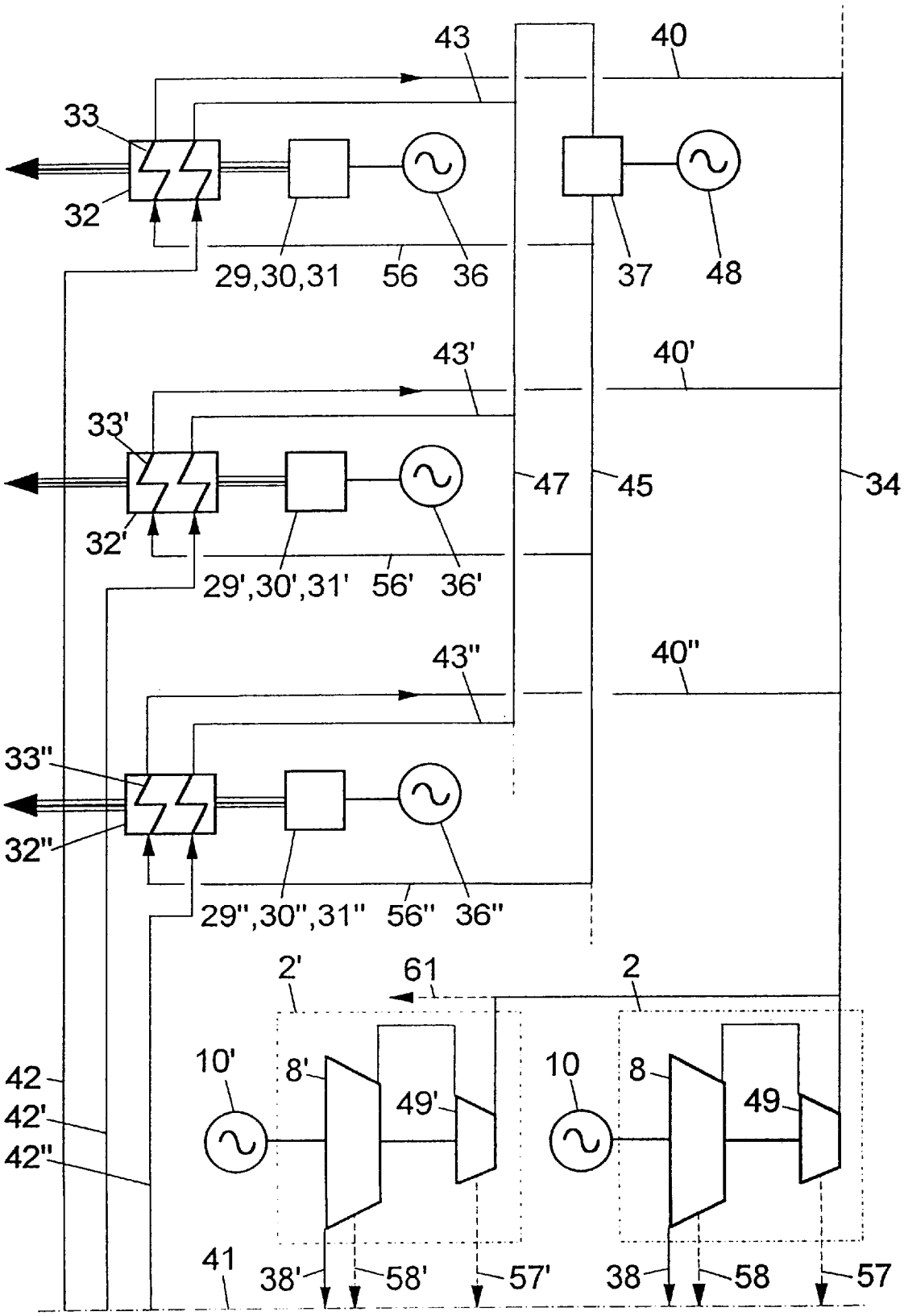
Figure 20:
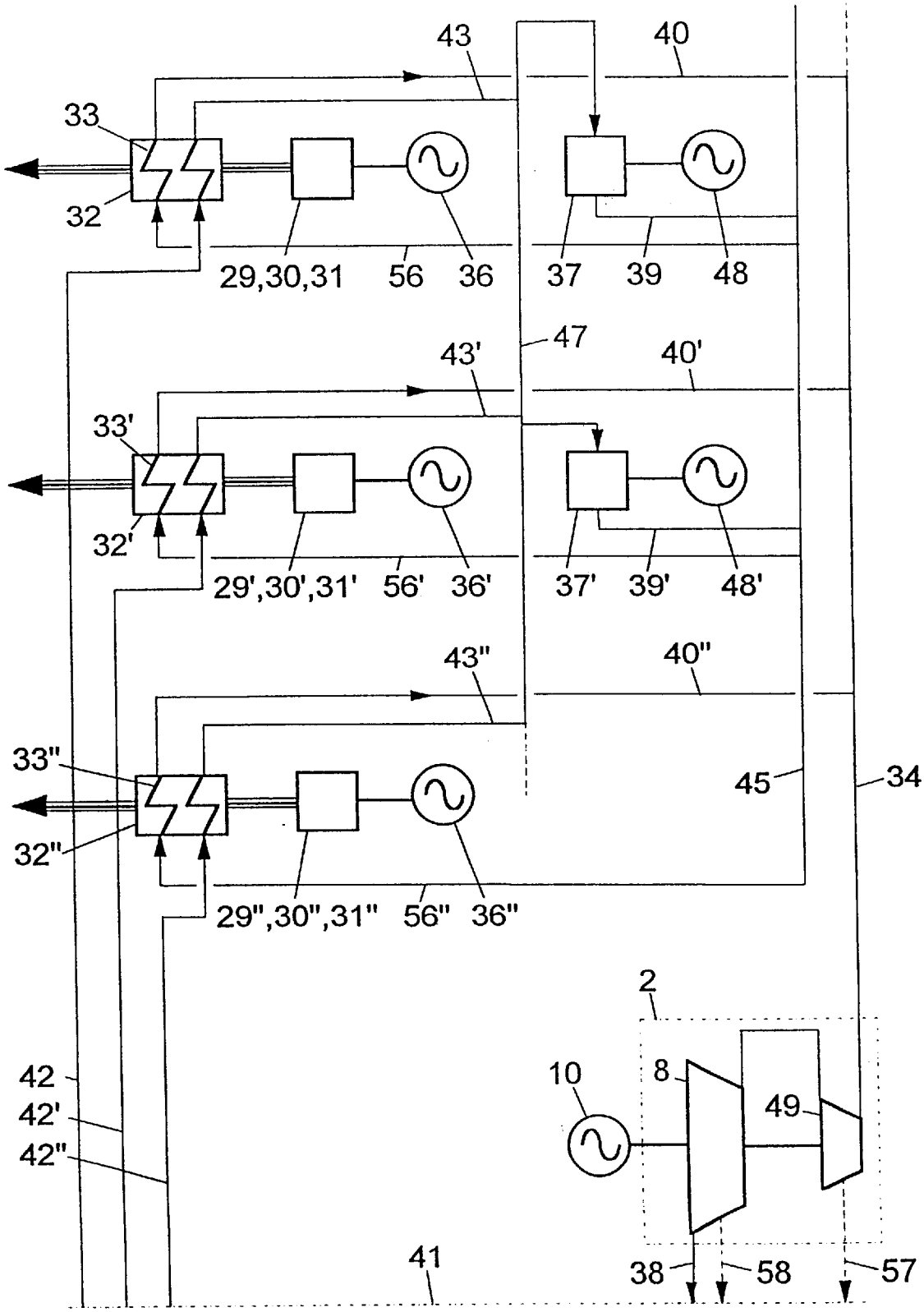
Figure 21:
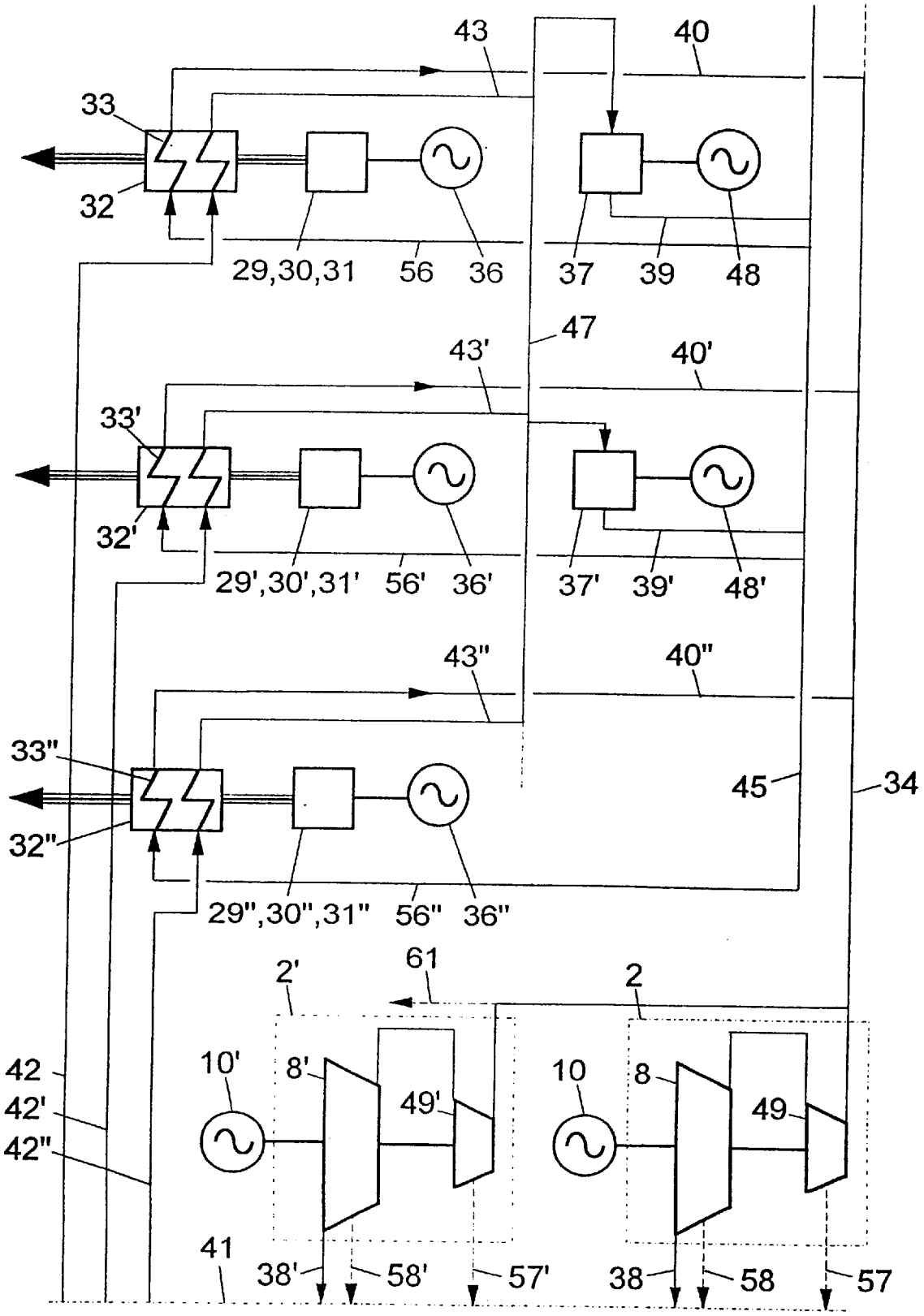

FIG. 1 shows, diagrammatically, the water/steam circuit of a nuclear power station, FIG. 2 shows, diagrammatically, a first variant of the converted power station, while retaining the steam turbine group with separator and retaining reheat by flowing steam (single-shaft installation), FIG. 3 shows, diagrammatically, a first variant of the converted power station, while retaining the steam turbine group with separator and retaining reheat by flowing steam (multishaft installation), FIG. 4 shows, diagrammatically, a second variant of the converted power station, while retaining the steam turbine group, but with adaptation of the parameters and possible omission of the separator, FIG. 5 shows, diagrammatically, a third variant of the converted power station, with replacement of the saturated-steam medium-pressure steam turbine in order to achieve reheat in the waste-heat boiler with omission of the separator and of the reheater using flowing steam, FIG. 6 shows an embodiment with three gas turbine sets with the associated waste-heat boilers, with the respective back-pressure steam turbines as single-shaft installation, with the medium-pressure steam main and a steam turbine group, FIG. 7 shows an embodiment with three gas turbine sets with the associated waste-heat boilers, with the respective back-pressure steam turbines as single-shaft installation, with the medium-pressure steam main and a plurality of steam turbine groups, FIG. 8 shows an embodiment with multishaft installations including back-pressure steam turbines, a medium-pressure steam main and a steam turbine group, FIG. 9 shows an embodiment with multishaft installations including back-pressure steam turbines, a medium-pressure steam main and a plurality of steam turbine groups, FIG. 10 shows an embodiment with three gas turbine sets with waste-heat boilers and a single back-pressure steam turbine, a high-pressure steam main and a steam turbine group, FIG. 11 shows an embodiment with three gas turbine sets with waste-heat boilers and a single back-pressure steam turbine, a high-pressure steam main and a plurality of steam turbine groups, FIG. 12 shows an embodiment with three gas turbine sets with waste-heat boilers and two back-pressure steam turbines, a high-pressure steam main, a medium-pressure steam main and a steam turbine group, FIG. 13 shows an embodiment with three gas turbine sets with waste-heat boilers and two back-pressure steam turbines, a high-pressure steam main, a medium-pressure steam main and a plurality of steam turbine groups, FIG. 14 shows an embodiment with three gas turbine sets with the associated waste-heat boilers with reheat, the respective back-pressure steam turbines as single-shaft installation, a hot reheater steam main and a steam turbine group with a new medium-pressure steam turbine, FIG. 15 shows an embodiment with three gas turbine sets with the associated waste-heat boilers with reheat, the respective back-pressure steam turbines as single-shaft installation, a hot reheater steam main and a plurality of steam turbine groups with new medium-pressure steam turbines, FIG. 16 shows an embodiment with multishaft installations including back-pressure steam turbines, a hot reheater steam main and a steam turbine group with a new medium-pressure steam turbine, FIG. 17 shows an embodiment with multishaft installations including back-pressure steam turbines, a hot reheater steam main and a plurality of steam turbine groups with new medium-pressure steam turbines, FIG. 18 shows an embodiment with three gas turbine sets with waste-heat boilers, a high-pressure steam main, a single back-pressure steam turbine, a medium-pressure steam main, a hot reheater steam main and a steam turbine group with a new medium-pressure steam turbine, FIG. 19 shows an embodiment with three gas turbine sets with waste-heat boilers, a high-pressure steam main, a single back-pressure steam turbine, a medium-pressure steam main, a hot reheater steam main and a plurality of steam turbine groups with new medium-pressure steam turbines, FIG. 20 shows an embodiment with three gas turbine sets with waste-heat boilers, a high-pressure steam main, two back-pressure steam turbines, a medium-pressure steam main, a hot reheater steam main and a steam turbine group with a new medium-pressure steam turbine and FIG. 21 shows an embodiment with three gas turbine sets with waste-heat boilers, a high-pressure steam main, two back-pressure steam turbines, a medium-pressure steam main, a hot reheater steam main and a plurality of steam turbine groups with new medium-pressure steam turbines.

DETAILED DESCRIPTION OF THE PREFERRED EMBODIMENTS

FIG. 1 shows, diagrammatically, the water/steam circuit of a nuclear power station as an example of a system generating saturated steam, having at least one steam turbine group.

Saturated steam, which is supplied through the steam line 3 to the saturated-steam medium-pressure steam turbine 4 of the steam turbine group 2, is generated in a nuclear steam generation system 1. The further part of the saturated steam generated is supplied to the reheater 7. In the embodiment shown, the steam turbine group 2 has one saturated-steam medium-pressure steam turbine 4. The exhaust steam from this saturated-steam medium-pressure steam turbine 4 flows via a transfer line 5, a separator (moisture precipitator) 6 and a reheater 7 to the low-pressure steam turbine 8. Steam from the nuclear steam generation system 1 is supplied via the branch steam line 9 to the reheater 7. In contrast to reheat in a boiler, reference is here made to reheat with flowing steam. The saturated-steam medium-pressure steam turbine 4 and the low-pressure steam turbine 8 drive the generator 10 via a shaft.

For energy reasons, the condensate from the separator 6 and the reheater 7 is fed to the preheater associated with the corresponding steam pressure or to the next lower pressure stage. In the present case, this means that the steam condensate appearing in the reheater 7 is supplied via the condensate line 51 to the last high-pressure preheater 25 (HP preheater) located before the nuclear steam generation system 1 and the condensate from the separator 6 is supplied via the condensate line 50 to the low-pressure preheater 17 (LP preheater) located before the feed-water tank degasser 21.

The exhaust steam from the low-pressure steam turbine 8 flows via the exhaust steam line 38 to the condenser 11 with the hotwell 12.

From the hotwell 12, the condensate is pumped by means of the condensate pump 13 through the condensate line 14 to the low-pressure preheaters 15, 16, 17. The low-pressure preheaters 15, 16, 17 are supplied, by means of the bleed steam lines 18, 19, 20, with steam from the low-pressure steam turbine 8.

The number and arrangement of the low-pressure preheaters may be considered as an example to explain the installation. As is known, the preheating in a steam power station can be carried out in many different variants.

The low-pressure preheater 17 is followed, in the direction of the feed water, by the feed-water tank/degasser 21. From the latter, the feed water is pumped by the high-pressure feed-water pump 22 to the high-pressure preheaters 23, 24, 25. The corresponding bleed steam lines extending from the saturated-steam medium-pressure steam turbine 4 to the feed-water tank/degasser 21 and to the high-pressure preheaters 23, 24, 25 are designated by the designations 26, 27, 28, 44.

The high-pressure preheaters can also be configured in many different variants with respect to number and arrangement.

From the last high-pressure preheater 25, the feed water finally flows via the feed-water line 55 to the nuclear steam generation system 1.

In FIG. 1, the bleed steam condensate from the preheaters is drained in cascade into the feed-water tank/degasser 21 or into the hotwell 12. Many different circuit variants are, of course, possible in this region.

Whereas the condensate from the high-pressure preheaters is, as is shown, generally drained in cascade into the feed-water tank/degasser 21, various combinations of cascade connections and feed pump connections are possible within low-pressure preheating columns.

The arrangement of the preheating column, i.e. the type of condensate drain and the presence of heat removal systems and aftercoolers, is irrelevant with respect to the present invention.

Particularly in the case of the steam temperatures which can be realized with light-water reactors, in the range from 260 to 315° C., the optimum steam power process demands saturated steam conditions at the steam turbine inlet, or only slight steam superheat up to a maximum of 30 K. In consequence, the pressures at the steam turbine inlet are in the range between 45 and 70 bar. For reasons of technical feasibility, but also for economic reasons, reheat by the nuclear system is excluded in most light-water reactor technologies. The only possibility for processing the steam in a low-pressure part is, therefore, steam drying in a separator 6, followed by reheat 7 using flowing steam.

With respect to parameters at the steam turbine inlet or with respect to the designation of a steam turbine, the concept of saturated steam used below is understood to mean steam conditions at the steam turbine inlet in the range of low wetness of approximately 5 to 8% up to superheating at a maximum of 30 K.

A system 1 generating saturated steam is understood to mean a saturated-steam boiler or a nuclear steam generation system.

The functional principle, the structure, the parameters and the like are then of no significance. A nuclear steam generation system can involve a boiling water reactor or even a pressure water reactor with the plurality of primary circuits.

The designation employed below for the steam turbine group 2 also includes, in addition to the existing saturated-steam medium-pressure steam turbine 4 and the new medium-pressure steam turbine 49, the low-pressure steam turbine 8 together with the separator 6, the reheater 7 and the connecting lines 3, 5, 9, but it is not absolutely necessary for the separator 6 and the reheater 7 to be present.

If, now, the nuclear steam generation system of the power station has to be put out of action for one of the reasons mentioned at the beginning, this part is replaced, in a first variant, by at least one gas turbine set 29, 30, 31, 36, at least one waste-heat boiler 32 and at least one back-pressure steam turbine 37, as is represented in a simplified manner in FIG. 2.

The gas turbine set 29, 30, 31, 36 includes a compressor 29, a combustion chamber 30, a gas turbine 31 and a generator 36. The exhaust gas from the gas turbine 31 is used in the waste-heat boiler 32 for the purpose of steam generation. The steam coming from the waste-heat boiler 32 is supplied via the live-steam line 43 to the back-pressure steam turbine 37. The exhaust steam from the back-pressure steam turbine 37 is supplied via the exhaust steam line 39 to the existing steam turbine group 2 with separator 6 and reheater 7.

The generator 36 of the gas turbine set 29, 30, 31, 36 is connected by a coupling to the back-pressure steam turbine 37, so that a single-shaft installation 35 is formed.

The steam parameters of the waste-heat boiler 32 and the embodiment of the back-pressure steam turbine 37 are now selected in such a way that the exhaust steam parameters of the back-pressure steam turbine 37 correspond to the conditions of the existing saturated-steam medium-pressure steam turbine 4 and of the reheater 7.

In this first variant, therefore, the nuclear steam generation system 1 is replaced by at least one gas turbine set 29, 30, 31, 36, consisting of compressor 29, combustion chamber 30, gas turbine 31 and generator 36, at least one waste-heat boiler 32 and at least one back-pressure steam turbine 37.

The line 41 designates the interface to the water/steam circuit, to which the various condensate lines and steam lines lead and from which the feed-water line 42 returns to the waste-heat boiler 32.

In the case of a steam power station, the possibility exists of increasing the efficiency of the steam process by raising the feed-water temperature by regenerative preheating. For this reason, nuclear power stations, such as that shown in FIG. 1, have a multi-stage regenerative preheating system available.

In a combined power station, i.e. when utilizing the waste heat of a gas turbine for steam generation in a waste-heat boiler, the efficiency of the overall process is a maximum when the power of the steam turbine is a maximum. This implies the greatest possible cooling of the exhaust gas in the waste-heat boiler, which in turn prevents regenerative preheating. The preheating of the feed-water condensate should, advantageously, take place in the waste-heat boiler.

For reasons associated with avoiding dew-point corrosion at the cold end of the waste-heat boiler, the feed-water temperature should not fall below a minimum as a function, for example, of the sulfur content of the gas turbine fuel. In addition, it can be necessary to degas the feed-water pumped into the waste-heat boilers. Both can involve limited preheating of the feed-water in the lower temperature range. In the specific case, use will initially be made of the condensate from the separator 6 and the reheater 7 and only in a later step will bleed be realized in the lower pressure range.

In all variants for converting the nuclear power station, the live steam parameters are raised due to the upstream connection of a back-pressure steam turbine. In consequence, the high-pressure preheaters, at least, and possibly also the high-pressure feed-water pump can no longer be employed in their present arrangement in the new system. In contrast, the condensate pump 13, the low-pressure preheaters 15–17 and the feed-water tank/degasser 21 may possibly be retained.

The regenerative preheating column described in accordance with FIG. 1, consisting of the low-pressure preheaters 15, 16, 17, the feed-water tank/degasser 21, the high-pressure feed-water pump 22 and the high-pressure preheaters 23, 24, 25, the bleed steam lines 18, 19, 20, 26, 27, 28, 44, the condensate drains and the like can therefore be omitted, partially or completely.

Depending on the steam parameters to be achieved, the at least one retrofitted waste-heat boiler 32 could be supplied with feed water by, for example, the existing high-pressure feed-water pump 22 from the feed-water tank/degasser 21 or by a separate feed-water pump from the hotwell 12 of the condenser 11 or from the feed-water tank/degasser 21.

The extent to which the realization of the preheating of the feed water of the waste-heat boiler in the lower temperature range takes place in the waste-heat boiler or by preheaters heated by bleed steam depends on the specific installations, the condensate temperature, the gas turbine fuel, the overall thermodynamic concept, the chemical process and the like which are employed.

The adaptations in this region of the water/steam circuit necessary due to the conversion of a system generating saturated steam and, having a steam turbine group, are, however, without significance for the invention and will not therefore be considered in the rest of the description.

In FIG. 2 and all the subsequent figures, the feed-water lines 42 extending from the water/steam circuit to the waste-heat boilers 32 are presented first. In addition, the condensate lines 50, 51 and steam lines 38, 18, 19, 20, 26, 27, 28, 44 extending from the steam turbine group 2, possibly to the water/steam circuit, are represented individually but also in combination. As has already been explained, the part of the water/steam circuit not represented is without significance to the invention.

In this first variant, the retrofitted back-pressure steam turbine 37, together with the gas turbine installation 29, 30, 31 and the generator 36, is arranged on one shaft. This concept is therefore designated as a single-shaft installation 35. The advantage of this single-shaft installation 35 consists initially in the saving of a separate generator for the back-pressure steam turbine 37 and in the operational advantages of a clear association between gas turbine set 29, 30, 31, 36, waste-heat boiler 32 and back-pressure steam turbine 37.

In addition to the possibility described of realizing a single-shaft installation 35, the at least one back-pressure steam turbine can, of course, also be embodied as a separate steam turbine set with its own generator. This concept is designated as a multishaft installation.

This can, in particular, be advantageous when a large number of gas turbine installations are necessary for converting the nuclear power station. It is then possible to combine the individual back-pressure steam turbine sets to form one back-pressure steam turbine set.

While a gas turbine installation is understood to mean an installation consisting of compressor, combustion chamber and gas turbine, the gas turbine set designation also includes the generator. The same definition applies to the steam turbine set, which comprises a possible plurality of steam turbine constituents and the associated generator.

In FIG. 3, the nuclear steam generation system 1 corresponding to the first variant in accordance with FIG. 2 is in turn replaced by at least one gas turbine set 29, 30, 31, 36, consisting of compressor 29, combustion chamber 30, gas turbine 31 and generator 36, at least one waste-heat boiler 32 and at least one back-pressure steam turbine set 37, 48. In this embodiment, however, the gas turbine set 29, 30, 31, 36 and back-pressure steam turbine set 37, 48 form a multishaft installation.

This multishaft installation embodiment also applies to the further subsequent variants. In this case, the number of gas turbine sets present is independent of the number of back-pressure steam turbine sets present.

In a manner analogous to FIG. 2, the interface to the water/steam circuit is designated by the line 41.

A further second variant, based on the first variant, for the conversion of a nuclear power station is represented in FIG. 4.

In this second variant, the arrangement of waste-heat boiler 32 and back-pressure steam turbine 37 is modified in such a way that the steam parameters between back-pressure steam turbine 37 and saturated-steam medium-pressure steam turbine 4 are displaced to more elevated temperatures and lower pressures in the ranges permissible for the saturated-steam medium-pressure steam turbine 4, in such a way that the final expansion point at the outlet from the saturated-steam medium-pressure steam turbine 4 is changed to lower steam wetnesses, if possible into the superheated range. The separator 6 can then be omitted and the reheater 7 operating with steam between saturated-steam medium-pressure steam turbine 4 and low-pressure steam turbine 8 can possibly have its load reduced or likewise, under favorable conditions, can be omitted.

The interface to the water/steam circuit is designated by the line 41.

In the third variant, shown in FIG. 5, the reheating system 7 with flowing steam is now also replaced for the relatively low steam parameters, in a further step, by a reheating system 33 in the waste-heat boiler 32. The result of this, however, is that the existing saturated-steam medium-pressure steam turbine 4 designed for saturated-steam conditions is replaced by a new medium-pressure steam turbine 49.

In this third variant, the waste-heat boiler 32 has an additional reheater 33 available in addition to the existing steam generation system for the provision of steam.

The exhaust steam from the back-pressure steam turbine 37 is supplied, via the exhaust-steam line 39, to the reheater 33 of the waste-heat boiler 32.

The steam for the (new) medium-pressure steam turbine 49 is exhaust steam, reheated in the waste-heat boiler 32, from the back-pressure steam turbine 37, which exhaust steam is supplied through the hot reheater steam line 40 of the (new) medium-pressure steam turbine 49. The (new) medium-pressure steam turbine 49 is designed in such a way that the parameters of its exhaust steam correspond to the parameters at the inlet to the low-pressure steam turbine 8.

The line 41 designates the interface to the water/steam circuit.

It was stated at the beginning that the nuclear steam generation system is replaced by at least one gas turbine set with waste-heat boiler and at least one back-pressure steam turbine.

FIGS. 2–5 only show one gas turbine set, one waste-heat boiler and one back-pressure steam turbine in each case. The possibility that a plurality of units may be present is indicated by the framing of gas turbine set, waste-heat boiler and back-pressure steam turbine.

FIGS. 6–21 show various technical circuit possibilities (embodiments) of a converted power station which contains a plurality of gas turbine sets. Three gas turbine sets are shown as an example in each case.

FIG. 6 shows an embodiment of the variant in accordance with FIGS. 2 and 4. The three, for example, gas turbine sets 29, 30, 31, 36; 29', 30', 31', 36'; 29", 30", 31", 36" with their associated waste-heat boilers 32, 32', 32" are present. The gas turbine sets 29, 30, 31, 36; 29', 30', 31', 36'; 29", 30", 31", 36", together with the back-pressure steam turbines 37, 37', 37", are embodied as single-shaft installations 35, 35', 35". The steam generated in the waste-heat boilers 32, 32', 32" is supplied via the live-steam lines 43, 43', 43" to three back-pressure steam turbines 37, 37', 37". At their exhaust steam end, the back-pressure steam turbines 37, 37', 37" are in connection via the exhaust steam lines 39, 39', 39" with a medium-pressure steam main 45. This medium-pressure steam main 45 extends to the steam turbine group 2.

FIG. 7 shows an embodiment in accordance with FIG. 6. The three, for example, gas turbine sets 29, 30, 31, 36; 29', 30', 31', 36'; 29", 30", 31", 36", with their associated waste-heat boilers 32, 32', 32", are again present. The gas turbine sets 29, 30, 31, 36; 29', 30', 31', 36'; 29", 30", 31", 36", together with the back-pressure steam turbines 37, 37', 37", are embodied as single-shaft installations 35, 35', 35". The steam generated in the waste-heat boilers 32, 32', 32" is supplied via the live-steam lines 43, 43', 43" to three back-pressure steam turbines 37, 37', 37". The back-pressure steam turbines 37, 37', 37" are in connection, at their exhaust steam end, with a medium-pressure steam main 45 via the exhaust steam lines 39, 39', 39". However, this medium-pressure steam main 45 extends to a plurality of steam turbine groups 2, 2', . . .

The specific number of these steam turbine groups 2, 2', . . . depends on the number of steam turbine groups which were present in the original power station. Correspondingly, a medium-pressure steam main 45 extended to still further steam turbine groups is indicated by the arrow 46.

The embodiment of FIG. 8, which is based on the variant of FIG. 3, shows multishaft installations. The three, for example, gas turbine sets 29, 30, 31, 36; 29', 30', 31', 36'; 29", 30", 31", 36" with their associated waste-heat boilers 32, 32', 32" are present. The back-pressure steam turbines 37, 37', 37" are separated from the gas turbine sets 29, 30, 31, 36; 29', 30', 31', 36'; 29", 30", 31", 36" and are each coupled to their own generator 48, 48', 48". The steam generated in the waste-heat boilers 32, 32', 32" is supplied via the live-steam lines 43, 43', 43" to three back-pressure steam turbines 37, 37', 37". The back-pressure pressure steam turbines 37, 37', 37" are in connection, at their exhaust steam end, with a medium-pressure steam main 45 via the exhaust steam lines 39, 39', 39". This medium-pressure steam main 45 extends to the steam turbine group 2.

FIG. 9 shows an embodiment similar to that illustrated in FIG. 8. The three, for example, gas turbine sets 29, 30, 31, 36; 29', 30', 31', 36'; 29"30", 31", 36" with their associated waste-heat boilers. 32, 32', 32" are again present. The back-pressure steam turbines 37, 37', 37" are separated from the gas turbine sets 29, 30, 31, 36; 29', 30', 31', 36'; 29", 30", 31", 36" and each of them is coupled to its own generator 48, 48', 48". The steam generated in the waste-heat boilers 32, 32', 32" is supplied via the live-steam lines 43, 43', 43" to three back-pressure steam turbines 37, 37'37". The back-pressure steam turbines 37, 37', 37" are in connection, at their exhaust steam end, with a medium-pressure steam main 45 via the exhaust steam lines 39, 39', 39". However, this medium-pressure steam main 45 extends to a plurality of steam turbine groups 2, 2', . . .

An extended medium-pressure steam main 45 and the presence of more than two steam turbine groups is indicated by the arrow 46.

FIG. 10 again shows an embodiment similar to that illustrated in FIG. 3. The multishaft installations with the three, for example, gas turbine sets 29, 30, 31, 36; 29', 30', 30', 36'; 29", 30", 31", 36" and the corresponding waste-heat boilers 32, 32', 32" are again present. However, only a single back-pressure steam turbine set 37, 48 with the back-pressure steam turbine 37 and the generator 48 is present in this embodiment. The steam generated in the waste-heat boilers 32, 32', 32" is supplied to a high-pressure steam main 47 via the live-steam lines 43, 43', 43". This main extends to the single back-pressure steam turbine 37. The back-pressure steam turbine 37 is in connection, at its exhaust steam end, with the steam turbine group 2 via the exhaust steam line 39.

FIG. 11 shows an embodiment in accordance with FIG. 10. The multishaft installations, with the three, for example, gas turbine sets 29, 30, 31, 36; 29', 30', 31', 36'; 29", 30", 31", 36" and the corresponding waste-heat boilers 32, 32', 32" are again present. In this embodiment, only one single back-pressure steam turbine set 37, 48 with the back-pressure steam turbine 37 and the generator 48 is again present. The steam generated in the waste-heat boilers 32, 32', 32" is supplied via the live-steam lines 43, 43', 43" to a high-pressure steam main 47. This main extends to the single back-pressure steam turbine 37. The back-pressure steam turbine 37 is in connection, however, at its exhaust steam end, with the plurality of steam turbine groups 2, 2', . . . via the exhaust steam line 39.

An extended exhaust steam line 39 and the presence of more than two steam turbine groups is indicated by the arrow 60.

FIG. 12 again shows an embodiment similar to that illustrated in FIG. 3. The multishaft installations with the three, for example, gas turbine sets 29, 30, 31, 36; 29', 30', 31', 36'; 29", 30", 31", 36" and the corresponding waste-heat boilers 32, 32', 32" are again present. In this embodiment, however, two back-pressure steam turbine sets 37, 48; 37', 48' with the back-pressure steam turbines 37, 37'and the generators 48, 48' are present. The steam generated in the waste-heat boilers 32, 321, 32" is supplied via the livesteam lines 43, 43', 43" to a high-pressure steam main 47. This main extends to the two back-pressure steam turbines 37, 37'. The back-pressure steam turbines 37, 37' are in connection, at their exhaust steam end, with the steam turbine group 2 via the exhaust steam lines 39, 39' and the medium-pressure steam main 45.

FIG. 13 shows an embodiment in accordance with FIG. 12. The multishaft installations with the three, for example, gas turbine sets 29, 30, 31, 36; 29', 30', 31', 36'; 29", 30", 31", 36" and the corresponding waste-heat boilers 32, 32', 32" are again present. In this embodiment also, two back-pressure steam turbine sets 37, 48; 37', 48' with the back-pressure steam turbines 37, 37' and the generators 48, 48' are present. The steam generated in the waste-heat boilers 32, 32', 32" is supplied via the live-steam lines 43, 43', 43" to a high-pressure steam main 47. This main extends to the two back-pressure steam turbines 37, 37'. The back-pressure steam turbines 37, 37', however, are in connection at their exhaust steam end with the plurality of steam turbine groups 2, 2', . . . via the exhaust steam lines 39, 39' and the medium-pressure steam main 45.

An extended medium-pressure steam main 45 and the presence of more than two steam turbine groups is indicated by the arrow 46.

FIG. 14 shows an embodiment similar to that illustrated in FIG. 5. The three, for example, gas turbine sets 29, 30, 31, 36; 29', 30', 31', 36'; 29", 30", 31", 36" with their associated waste-heat boilers 32, 32', 32" are present. The waste-heat boilers 32, 32', 32" have reheaters 33, 33', 33". The gas turbine sets 29, 30, 31, 36; 29', 30', 31', 36'; 29", 30", 31", 36", together with the back-pressure steam turbines 37, 37', 37". are embodied as single-shaft installations 35, 35', 35". The steam generated in the waste-heat boilers 32, 32', 32" is supplied via the live-steam lines 43, 43', 43" to three back-pressure steam turbines 37, 37', 37". The back-pressure steam turbines 37, 37', 37" are in connection, at their exhaust steam end, with the reheaters 33, 33', 33" of the waste-heat boilers 32, 32', 32", via the exhaust steam lines 39, 39', 39". The reheated steam is supplied by the waste-heat boilers 32, 32', 32" to a hot reheater steam main 34 via the hot reheater lines 40, 40', 40". This hot reheater steam main 34 extends to the newly installed medium-pressure steam turbine 49 of the steam turbine group 2.

FIG. 15 shows an embodiment similar to that illustrated in FIG. 14. The three, for example, gas turbine sets 29, 30, 31, 36; 29', 30', 31', 36'; 29", 30", 31", 36" with their associated waste-heat boilers 32, 32'), 32" are again present. The waste-heat boilers 32, 32', 32" have reheaters 33, 33', 33". The gas turbine sets 29, 30, 31, 36; 291, 30', 31', 36'; 29", 30", 31", 36", together with the back-pressure steam turbines 37, 37', 37", are embodied as single-shaft installations 35,35', 35". The steam generated in the waste-heat boilers 32, 32', 32" is supplied via the live-steam lines 43, 43', 43" to three back-pressure steam turbines 37, 37', 37". The back-pressure steam turbines 37, 37', 37" are in connection, at their exhaust steam end, with the reheaters 33, 33', 33" of the waste-heat boilers 32, 32', 32", via the exhaust steam lines 39, 39', 39". The reheated steam is supplied by the waste-heat boilers 32, 32', 32" via the hot reheater lines 40, 40', 40" to a hot reheater steam main 34. The hot reheater steam main 34, however, extends to the plurality of new medium-pressure steam turbines 49, 49' of the steam turbine groups 2, 2'.

An extended hot reheater steam main 34 and the presence of more than two steam turbine groups are indicated by the arrow 61.

The embodiment of FIG. 16, which is likewise based on the variant in FIG. 5, shows multishaft installations. The three, for example, gas turbine sets 29, 30, 31, 36; 29', 30', 31', 36'; 29", 30", 31", 36" with their associated waste-heat boilers 32, 32', 32" are present. The waste-heat boilers 32, 32', 32" have reheaters 33, 33', 33". The back-pressure steam turbines 37, 37', 37" are separated from the gas turbine sets 29, 30, 31, 36; 29', 30', 31', 36'; 29", 30", 31", 36" and each of them is coupled to its own generator 48, 48', 48". In a manner analogous to the embodiment of FIG. 14, the steam generated in the waste-heat boilers 32, 32', 32" is supplied via the live-steam lines 43, 43', 43" to three back-pressure steam turbines 37, 37', 37". The back-pressure steam turbines 37, 37', 37" are in connection, at their exhaust steam end, with the reheaters 33, 33', 33" of the waste-heat boilers 32, 32', 32", via the exhaust steam lines 39, 39', 39". The reheated steam is supplied by the waste-heat boilers 32, 32', 32" via the hot reheater lines 40, 40', 40" to a hot reheater steam main 34. This hot reheater steam main 34 extends to the newly installed medium-pressure steam turbine 49 of the steam turbine group 2.

FIG. 17 shows an embodiment similar to that illustrated in FIG. 16. The multishaft installations with the three, for example, gas turbine sets 29, 30, 31, 36; 29', 30'31', 36'; 29", 30", 31", 36" with their associated waste-heat boilers 32, 32', 32" are again present. The waste-heat boilers 32, 32', 32" have reheaters 33, 33', 33". The back-pressure steam turbines 37, 37', 37" are separated from the gas turbine sets 29, 30, 31, 36; 29', 30', 31', 36'; 29", 30", 31", 36" and each of them is coupled to its own generator 48, 48', 48". In a manner analogous to the embodiment of FIG. 14, the steam generated in the waste-heat boilers 32, 32', 32" is supplied via the live-steam lines 43, 43', 43" to three back-pressure steam turbines 37, 37', 37". The back-pressure steam turbines 37, 37', 37" are in connection, at their exhaust steam end, with the reheaters 33, 33', 33," of the waste-heat boilers 32, 32', 32", via the exhaust steam lines 39, 39', 39". The, reheated steam is supplied by the waste-heat boilers 32, 32', 32" via the hot reheater lines 40, 40', 40" to a hot reheater steam main 34. This hot reheater steam main 34, however, extends to the plurality of newly installed medium-pressure steam turbines 49, 49' of the steam turbine groups 2, 2'.

An extended hot reheater steam main 34 and the presence of more than two steam turbine groups is indicated by the arrow 61.

FIG. 18 again shows an embodiment of the variant in accordance with FIG. 5. The multishaft installations with the three, for example, gas turbine sets 29, 30, 31, 36; 29', 30', 31', 36'; 29", 30", 31", 36" and the corresponding waste-heat boilers 32, 32', 32" are again present. The waste-heat boilers 32, 32', 32" have reheaters 33, 331, 33". In this embodiment, however, only one single back-pressure steam turbine set 37, 48 with the back-pressure steam turbine 37 and the generator 48 is present. The steam generated in the waste-heat boilers 32, 32', 32" is supplied via the live-steam lines 43, 43', 43" to a high-pressure steam main 47. This main extends to a single back-pressure steam turbine 37 with generator 48. At its exhaust steam end, the back-pressure steam turbine 37 is in connection via the medium-pressure steam main 45 and the cold reheater lines 56, 56', 56" with the reheaters 33, 33', 33" of the waste-heat boilers 32, 32', 32". The reheated steam is supplied by the waste-heat boilers 32, 32', 32" via the hot reheater lines 40, 40', 40" to a hot reheater steam main 34. This hot reheater steam main 34 extends to the newly installed medium-pressure steam turbine 49 of the steam turbine group 2.

FIG. 19 shows an embodiment similar to that illustrated in FIG. 18. The multishaft installations with the three, for example, gas turbine sets 29, 30, 31, 36; 29', 30', 31'36'; 29", 30", 31", 36" and the corresponding waste-heat boilers 32, 32', 32" are again present. The waste-heat boilers 32, 32', 32" have reheaters 33, 33', 33'. In this embodiment, only one single back-pressure steam turbine set 37, 48 with the back-pressure steam turbine 37 and the generator 48 is again present. The steam generated in the waste-heat boilers 32, 32', 32" is supplied via the live-steam lines 43, 43', 43 " to a high-pressure steam main 47. This main extends to a single back-pressure steam turbine 37 with generator 48. At its exhaust steam end, the back-pressure steam turbine 37 is in connection via the medium-pressure steam main 45 and the cold reheater lines 56, 56', 56" with the reheaters 33, 33', 33" of the waste-heat boilers 32, 32', 32". The reheated steam is supplied by the waste-heat boilers 32, 32', 32" via the hot reheater lines 40, 40', 40" to a hot reheater steam main 34. This hot reheater steam main 34 extends to the plurality of newly installed medium-pressure steam turbines 49, 49' of the steam turbine groups 2, 2'.

An extended hot reheater steam main 34 and the presence of more than two steam turbine groups is indicated by the arrow 61.

FIG. 20 again shows an embodiment similar to that illustrated in FIG. 5. The multishaft installations with the three, for example, gas turbine sets 29, 30, 31, 36; 29', 30', 31', 36'; 29", 30", 31", 36" and the corresponding waste-heat boilers 32, 32" are again present. The waste-heat boilers 32, 32', 32" have reheaters 33, 33', 33". In this embodiment, however, two back-pressure steam turbine sets 37, 48; 37', 48' with the back-pressure steam turbines 37, 37' and the generators 48, 48' are present. The steam generated in the waste-heat boilers 32, 32', 32" is supplied via the live-steam lines 43, 43', 43" to a high-pressure steam main 47. This main extends to the two back-pressure steam turbines 37, 37'with the generators 48, 48'. At their exhaust steam end, the back-pressure steam turbines 37, 37' are in connection via the exhaust steam lines 39, 39', the medium-pressure steam main 45 and the cold reheater lines 56, 56', 56" with the reheaters 33, 33', 33" of the waste-heat boilers 32, 32', 32". The reheated steam is supplied by the waste-heat boilers 32, 32', 32" via the hot reheater lines 40, 40', 40" to a hot reheater steam main 34. This hot reheater steam main 34 extends to the newly installed medium-pressure steam turbine 49 of the steam turbine group 2.

FIG. 21 shows an embodiment similar to that illustrated in FIG. 20. The multishaft installations with the three, for example, gas turbine sets 29, 30, 31, 36; 29', 30', 31', 36'; 29", 30", 31", 36" and the corresponding waste-heat boilers 32, 32', 32" are again present. The waste-heat boilers 32, 32', 32" have reheaters 33, 33', 33". In this embodiment also, the two back-pressure steam- turbine sets 37, 48; 37', 48' with the back-pressure steam turbines 37, 37' and the generators 48, 48' are present. The steam generated in the waste-heat boilers 32, 32', 32" is supplied via the live-steam lines 43, 43', 43 " to a high-pressure steam main 47. This main extends to the two back-pressure steam turbines 37, 37' with the generators 48, 48'. At their exhaust steam end, the back-pressure steam turbines 37, 37' are in connection via the exhaust steam lines 39, 39', the medium-pressure steam main 45 and the cold reheater lines 56, 56', 56" with the reheaters 33, 33', 33" of the waste-heat boilers 32, 32', 32". The reheated steam is supplied by the waste-heat boilers 32, 32', 32" via the hot reheater lines 40, 40', 40" to a hot reheater steam main 34. This hot reheater steam main 34 extends to the plurality of newly installed medium-pressure steam turbines 49, 49' of the steam turbine groups 2, 2'.

An extended hot reheater steam main 34 and the presence of more than two steam turbine groups is indicated by the arrow 61.

As an alternative, two or more back-pressure steam turbines with generators can also be present. As an example, one converted power station could have four gas turbine sets with four waste-heat boilers, each two waste-heat boilers being connected, at their exhaust steam end, with one main so that four gas turbine sets are combined with two back-pressure steam turbines with one generator each. This arrangement could, for example, be selected if the converted power station has two steam turbine groups.

Yet more variants are possible. Which variant is selected in the end depends, inter alia, on the steam turbine groups originally present, on economic considerations, and the structure of the existing power station.

The invention is not, of course, limited to the embodiment examples described. For example, individual steam lines can also be provided, between the respective power station components, instead of the high-pressure steam main 47, the medium-pressure steam main 45 or the hot reheater steam main 34.

What is claimed is:

1. A method of converting a system generating saturated steam, the system having at least one steam turbine group which has a saturated-steam medium-pressure steam turbine, the method comprising the steps of:

replacing a portion of the system generating saturated steam with at least one gas turbine set, at least one waste-heat boiler, and at least one back-pressure steam turbine;

generating steam in the at least one waste-heat boiler using the exhaust gas of at least one gas turbine of the at least one gas turbine set;

supplying the steam generated in the at least one waste-heat boiler via a live-steam line to the at least one back-pressure steam turbine; and supplying the exhaust steam of the at least one back-pressure steam turbine to the at least one steam turbine group.

2. The method as claimed in claim 1, further comprising:

supplying the exhaust steam of the at least one back-pressure steam turbine via an exhaust steam line to the at least one saturated-steam medium-pressure steam turbine.

3. The method as claimed in claim 1, wherein the at least one steam turbine group has a separator and a reheater between the saturated-steam medium-pressure steam turbine and a low-pressure steam turbine following an exhaust steam end of the saturated-steam medium-pressure steam turbine, wherein the at least one waste-heat boiler and the at least one back-pressure steam turbine are configured and arranged so that the steam parameters between the back-pressure steam turbine and the saturated-steam medium-pressure steam turbine include elevated temperatures and lower pressures within the ranges permissible for the saturated-steam medium-pressure steam turbine, and so that the final expansion point at the outlet from the saturated-steam medium-pressure steam turbine has lower steam wetnesses, and comprising the step of removing the separator.

4. The method according to claim 3, wherein the final expansion point at the outlet from the saturated-steam medium-pressure steam turbine is in a superheated steam range, and comprising the step of removing the reheater.

5. A converted power station formed by a method comprising the steps of:

providing a system generating saturated steam, the system having at least one steam turbine group which has a saturated-steam medium-pressure steam turbine;

replacing a portion of the system generating saturated steam with at least one gas turbine set, at least one waste-heat boiler, and at least one back-pressure steam turbine;

generating steam in the at least one waste-heat boiler using the exhaust gas of at least one gas turbine of the at least one gas turbine set;

supplying the steam generated in the at least one waste-heat boiler via a live-steam line to the at least one back-pressure steam turbine; and supplying the exhaust steam of the at least one back-pressure steam turbine to the at least one steam turbine group.

6. A converted power station in accordance with claim 5, the method further comprising:

supplying the exhaust steam of the at least one back-pressure steam turbine via an exhaust steam line to the at least one saturated-steam medium-pressure steam turbine.

7. A converted power station in accordance with claim 5, wherein the at least one steam turbine group has a separator and a reheater between the saturated-steam medium-pressure steam turbine and a low-pressure steam turbine following an exhaust steam end of the saturated-steam medium-pressure steam turbine, wherein the at least one waste-heat boiler and the at least one back-pressure steam turbine are configured and arranged so that the steam parameters between the back-pressure steam turbine and the saturated-steam medium-pressure steam turbine include elevated temperatures and lower pressures within the ranges permissible for the saturated-steam medium-pressure steam turbine, and so that the final expansion point at the outlet from the saturated-steam medium-pressure steam turbine has lower steam witnesses, and the method comprising the step of removing the separator.

8. A converted power station in accordance with claim 7, wherein the final expansion point at the outlet from the saturated-steam medium-pressure steam turbine has a superheated steam wetness, and the method comprising the step of removing the reheater.

* * * * *